US012140336B2

(12) United States Patent
Kim et al.

(10) Patent No.: US 12,140,336 B2
(45) Date of Patent: Nov. 12, 2024

(54) BLOWER

(71) Applicant: LG ELECTRONICS INC., Seoul (KR)

(72) Inventors: Kidong Kim, Seoul (KR); Jaehyeon Kim, Seoul (KR); Seokho Choi, Seoul (KR); Changhoon Lee, Seoul (KR); Jaehyuk Jung, Seoul (KR); Hosik Jang, Seoul (KR); Seungho Baek, Seoul (KR); Haein Jung, Seoul (KR); Kibbum Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/768,993

(22) PCT Filed: Oct. 16, 2020

(86) PCT No.: PCT/KR2020/014144
§ 371 (c)(1),
(2) Date: Apr. 14, 2022

(87) PCT Pub. No.: WO2021/075896
PCT Pub. Date: Apr. 22, 2021

(65) Prior Publication Data

US 2024/0102691 A1 Mar. 28, 2024

(30) Foreign Application Priority Data

Oct. 18, 2019 (KR) ..... 10-2019-0129561
Oct. 18, 2019 (KR) ..... 10-2019-0129564
May 18, 2020 (KR) ..... 10-2020-0059157

(51) Int. Cl.
*F24F 13/12* (2006.01)
*F04D 17/00* (2006.01)
(Continued)

(52) U.S. Cl.
CPC ..... *F24F 13/12* (2013.01); *F04D 17/00* (2013.01); *F04D 29/462* (2013.01); *F04D 29/668* (2013.01); *F24F 13/072* (2013.01)

(58) Field of Classification Search
CPC .... F04D 29/462; F04D 29/668; F04D 29/522; F04D 29/644; F04D 29/701;
(Continued)

(56) References Cited

U.S. PATENT DOCUMENTS

2019/0170157 A1* 6/2019 Mogridge ..... F04D 25/08

FOREIGN PATENT DOCUMENTS

CN 104863871 8/2015
CN 104863871 A * 8/2015
(Continued)

OTHER PUBLICATIONS

International Search Report dated Feb. 16, 2021 issued in Application No. PCT/KR2020/014144.
(Continued)

*Primary Examiner* — David E Sosnowski
*Assistant Examiner* — Maxime M Adjagbe
(74) *Attorney, Agent, or Firm* — KED & ASSOCIATES, LLP

(57) ABSTRACT

A blower is disclosed. The blower includes a fan configured to generate flow of air, a lower body providing an internal space in which the fan is installed, and having a suction hole through which air passes, an upper body positioned over the lower body and providing an internal space in which air discharged from the fan flows, a damper positioned behind the upper body, and a discharge port formed between an end of the upper body and an end of the damper, in which the upper body includes an opening formed at a rear end of the upper body and communicating with the internal space of the upper body, and the damper opens and closes the
(Continued)

discharge port while moving in a front-rear direction behind the opening.

18 Claims, 24 Drawing Sheets

(51) Int. Cl.
*F04D 29/46* (2006.01)
*F04D 29/66* (2006.01)
*F24F 13/072* (2006.01)

(58) Field of Classification Search
CPC ..... F04D 29/703; F04D 19/002; F24F 13/12; F24F 13/072; F24F 13/065
See application file for complete search history.

(56) References Cited

FOREIGN PATENT DOCUMENTS

| | | | | |
|---|---|---|---|---|
| CN | 109891161 A | * | 6/2019 | ..... F24F 1/0011 |
| JP | 5452757 | | 3/2014 | |
| JP | 2014-173425 | | 9/2014 | |
| JP | 2016-000967 | | 1/2016 | |
| KR | 10-0728347 | | 6/2007 | |
| KR | 10-2009-0047572 | | 5/2009 | |
| KR | 10-2011-0099318 | | 9/2011 | |
| KR | 10-2013-0045421 | | 5/2013 | |
| KR | 10-2019-0015325 | | 2/2019 | |

OTHER PUBLICATIONS

Korean Office Action dated Jan. 18, 2023 issued in Application No. 10-2019-0129561.

* cited by examiner

BLOWER

CROSS-REFERENCE TO RELATED PATENT APPLICATIONS

This application is a U.S. National Stage Application under 35 U.S.C. §371 of PCT Application No. PCT/KR2020/014144, filed Oct. 16, 2020, which claims priority to Korean Patent Application Nos. 10-2019-0129561, filed Oct. 18, 2019, 10-2019-0129564, filed Oct. 18, 2019 and 10-2020-0059157, filed May 18, 2020, whose entire disclosures are hereby incorporated by reference.

FIELD OF THE DISCLOSURE

The present disclosure relates to a blower. In particular, the present disclosure relates to a blower that can variously adjust the direction of air.

RELATED ART

A blower can circulate air in an interior or generate airflow toward a user by generating flow of air. Recently, many researches are conducted about the air discharge structure of a blower that can make a user feel pleasant.

A blower has been disclosed in Korean Patent Application Publication No. 10-2019-0142280. The blower can directly provide air, which is blown by a fan, to a user. In this case, there is an advantage that the air discharged from the blower can be sent to a long distance, but there is a problem that a user may feel unpleasant due to excessively strong airflow that is provided to the user.

Fans that blow air using Coanda Effect have been disclosed in Korean Patent Application Publication No. 10-2011-0099318, Korean Patent Application Publication No. 10-2013-0045421, and Korean Patent Application Publication No. 10-2019-0015325. However, those fans have a problem that they can discharge air only to a predetermined region. Further, there is a problem that it is required to move or turn fans in order to change the wind direction, thereby consuming power or generating noise or vibration.

DISCLOSURE

Technical Problem

An objective of the present disclosure is to solve the problems described above and other problems.

Another objective may be to provide a blower that can provide pleasance to a user by indirectly providing air, which is discharged from a fan, to the user.

Another objective may be to provide a blower that can variously adjust the direction of air at the position.

Another objective may be to provide a blower that can generate airflow that is intensively discharged, can generate airflow that is distributed or spread, or can generate airflow that is discharged forward or rearward.

Another objective may be to provide a blower than can minimize foreign substances such as dust that enter the device by closing an air outlet when a fan is not operated.

Technical Solution

According to an aspect of the present disclosure for achieving the objectives, there is provided a blower that includes a fan configured to generate flow of air, a lower body providing an internal space in which the fan is installed, and having a suction hole through which air passes, an upper body positioned over the lower body and providing an internal space in which air discharged from the fan flows, a damper positioned behind the upper body, and a discharge port formed between an end of the upper body and an end of the damper, in which the upper body includes an opening formed at a rear end of the upper body and communicating with the internal space of the upper body, and the damper opens and closes the discharge port while moving in a front-rear direction behind the opening.

According to another aspect of the present disclosure, the upper body may be elongated in an up-down direction, the upper body may further include a first body positioned at the left side of the opening and having a rear end adjacent to the end of the damper and a second body positioned at the right side of the opening and having a rear end adjacent to the end of the damper, and the opening may be formed between the rear end of the first upper body and the rear end of the second upper body.

According to another aspect of the present disclosure, a front-rear length of the upper body may be larger than a left-right width of the upper body, the first upper body may have an outer surface that is convex to the left, and the second upper body may have an outer surface that is convex to the right.

According to another aspect of the present disclosure, the damper may further include: a plate that is a plate disposed at the opening and divides the opening into a first opening positioned at the left of the plate and a second opening positioned at the right of the plate; a first guide elongated at an angle left and forward from a rear end of the plate; and a second guide elongated at an angle right and forward from the rear end of the plate, and the discharge port may further include: a first discharge port formed between a front end of the first guide and the rear end of the first upper body; and a second discharge port formed between a front end of the second guide and the rear end of the second upper body.

According to another aspect of the present disclosure, the blower may further include a separation wall disposed in the internal space of the upper body and dividing the internal space of the upper body into a first space positioned at the left of the separation wall and a second space positioned at the right of the separation wall, in which the plate may define a boundary between the first space and the second space in cooperation with the separation wall, and may be coupled to the separation wall to be movable in the front-rear direction.

According to another aspect of the present disclosure, the blower may further include a moving assembly coupled to the separation wall and the plate between the separation wall and the plate, in which the moving assembly may further include: a motor configured to provide rotational force; a pinion connected to a rotary shaft of the motor; and a rack extending forward from a front end of the plate and engaged with the pinion, and the separation wall may further include a slot formed through the separation wall in the front-rear direction and having the rack inserted to be movable in the front-rear direction therein.

According to another aspect of the present disclosure, the first guide and the second guide may close the first discharge port and the second discharge port by coming in contact with the rear ends of the first upper body and the second upper body, respectively, or may open the first discharge port and the second discharge port by separating rearward from the rear ends of the first upper body and the second upper body, respectively.

According to another aspect of the present disclosure, the motor may adjust the degrees that the first guide and the second guide are spaced rearward apart from the rear ends of the first upper body and the second upper body, respectively.

According to another aspect of the present disclosure, the damper may further include: a body positioned behind the opening and forming a rear surface of the damper; a first guide elongated at an angle left and forward from a left end of the body; and a second guide elongated at an angle right and forward from a right end of the body, and the discharge port may further include: a first discharge port formed between the first guide and the first upper body; and a second discharge port formed between the second guide and the second upper body.

According to another aspect of the present disclosure, the first guide may cover a portion of the first upper body, and the second guide may cover a portion of the second upper body.

According to another aspect of the present disclosure, the blower may further include a splinter disposed between the opening and the body, in which the splinter may further include: a first inclined surface facing the rear end of the first upper body and formed at an angle with respect to a front surface of the body; and a second inclined surface facing the rear end of the second upper body and formed at an angle with respect to a front surface of the body, and a gap between the first inclined surface and the second inclined surface in a left-right direction may increase rearward.

According to another aspect of the present disclosure, the blower may further include a moving assembly installed in the internal space of the upper body and coupled to the damper, in which the moving assembly further may include: a motor configured to provide rotational force; a pinion connected to a rotary shaft of the motor; and a rack elongated in the front-rear direction and engaged with the pinion, and the rack may be movably or rotatably coupled to the first guide or the second guide.

According to another aspect of the present disclosure, the rack may further include a slot formed through the rack in the left-right direction and elongated in the front-rear direction, and the blower may further include a slider protruding toward the slot from an inner surface of the first upper body or an inner surface of the second upper body, and inserted in the slot to be movable in the front-rear direction.

According to another aspect of the present disclosure, the moving assembly may further include a first moving assembly and a second moving assembly that are spaced apart from each other in the up-down direction, in which the first moving assembly may further include: a first pin provided at a rear end of a rack of the first moving assembly; and a first link fixed to an inner surface of the first guide or an inner surface of the second guide and having the first pin coupled thereto to be movable in a direction crossing the front-rear direction, and the second moving assembly may further include: a second pin provided at a rear end of a rack of the second moving assembly; and a second link fixed to an inner surface of the first guide or an inner surface of the second guide and having the second pin rotatably coupled thereto.

According to another aspect of the present disclosure, the first link may further include a first link hole formed through the first link in the left-right direction, elongated forward and upward, and having the first pin movably inserted therein, and the second link may further include: a second link: and a second link groove in which the second pin is rotatably inserted.

According to another aspect of the present disclosure, the rack of the first moving assembly may be engaged with a pinion of the first moving assembly under the pinion of the first moving assembly, and the rack of the second moving assembly may be engaged with a pinion of the second moving assembly over the pinion of the second moving assembly.

According to another aspect of the present disclosure, a rotation speed of a motor of the first moving assembly may be synchronized with or controlled to be different from a rotation speed of a motor of the second moving assembly.

According to another aspect of the present disclosure, the first moving assembly and the second moving assembly may be controlled such that any one of them is not driven and the other one is driven.

According to another aspect of the present disclosure, inner surfaces of the first guide and the second guide may close the first discharge port and the second discharge port by coming in contact with outer surfaces of the first upper body and the second upper body, respectively, or may open the first discharge port and the second discharge port by separating rearward from the outer surfaces of the first upper body and the second upper body, respectively.

According to another aspect of the present disclosure, the first guide may cross or separate rearward from a first extension line extending along the first inclined surface when the first discharge port is opened, and the second guide may cross or separate rearward from a second extension line extending along the second inclined surface when the second discharge port is opened.

Advantageous Effects

Effects of the blower according to the present disclosure are as follows.

According to at least one of embodiments of the present disclosure, since air discharged from a fan is indirectly provided to a user through a plurality of channels, it is possible to provide a blower that can provides pleasance to a user.

According to at least one of embodiments of the present disclosure, it is possible to variously adjust the direction of air by opening/closing a discharge port or adjusting the degree of opening of the discharge port through which air discharged from the fan passes without moving or rotating the blower.

According to at least one of embodiments of the present disclosure, air flowing forward along the side of the blower can generate intensive airflow, can generate spreading airflow by being distributed to the left and right, or can be discharged rearward by adjusting the degree of opening of a discharge port through which air discharged from the fan passes.

According to at least one of embodiments of the present disclosure, since a discharge port is closed in correspondence to a non-operation state of the fan, it is possible to minimize foreign substance such as dust entering the blower.

Applicability and an additional range of the present disclosure will be made clear from the following detailed description. However, various changes and modification within the spirit and scope of the present disclosure can be clearly understood by those skilled in the art, so the detailed description and specific embodiments such as preferred embodiments of the present disclosure should be understood only as examples.

BRIEF DESCRIPTION OF THE DRAWINGS

FIG. 7(*b*) is a view illustrating closing of a discharge port at the first position of the damper.

FIG. 8(*b*) is a view illustrating intensive airflow generated by the blower at the second position of the damper.

FIG. 9(*b*) is a view illustrating spreading airflow generated by the blower at the third position of the damper.

DESCRIPTION OF EXEMPLARY EMBODIMENTS

Figure 1:
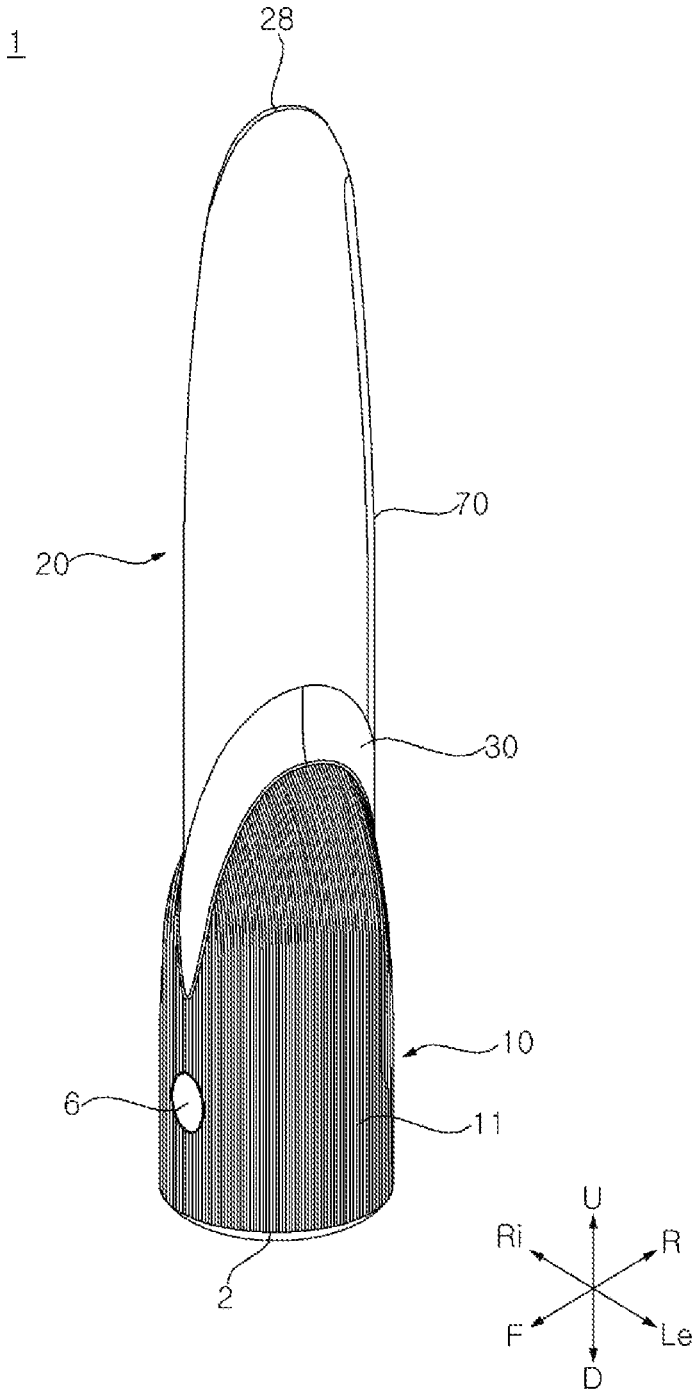
FIG. 1 is a perspective view of a blower according to an embodiment of the present disclosure.

Hereafter, embodiments of the present disclosure will be described in detail with reference to the accompanying drawings and the same or similar components are given the same reference numerals regardless of the numbers of figures and are not repeatedly described.

In the following description, if it is decided that the detailed description of known technologies related to the present invention makes the subject matter of the embodiments described herein unclear, the detailed description is omitted. Further, the accompanying drawings are provided only for easy understanding of embodiments disclosed in the specification, the technical spirit disclosed in the specification is not limited by the accompanying drawings, and all changes, equivalents, and replacements should be understood as being included in the spirit and scope of the present disclosure.

Terms including ordinal numbers such as 'first', 'second', etc., may be used to describe various components, but the components are not to be construed as being limited to the terms. The terms are used only to distinguish one component from another component.

The characters 'U' (up), 'D' (down), 'Le' (left), 'Ri' (right), 'F' (forward), and 'R' (rearward) indicating directions are provided only for convenience of description and the spirit disclosed in the specification is not limited by the characters.

Figure 2:
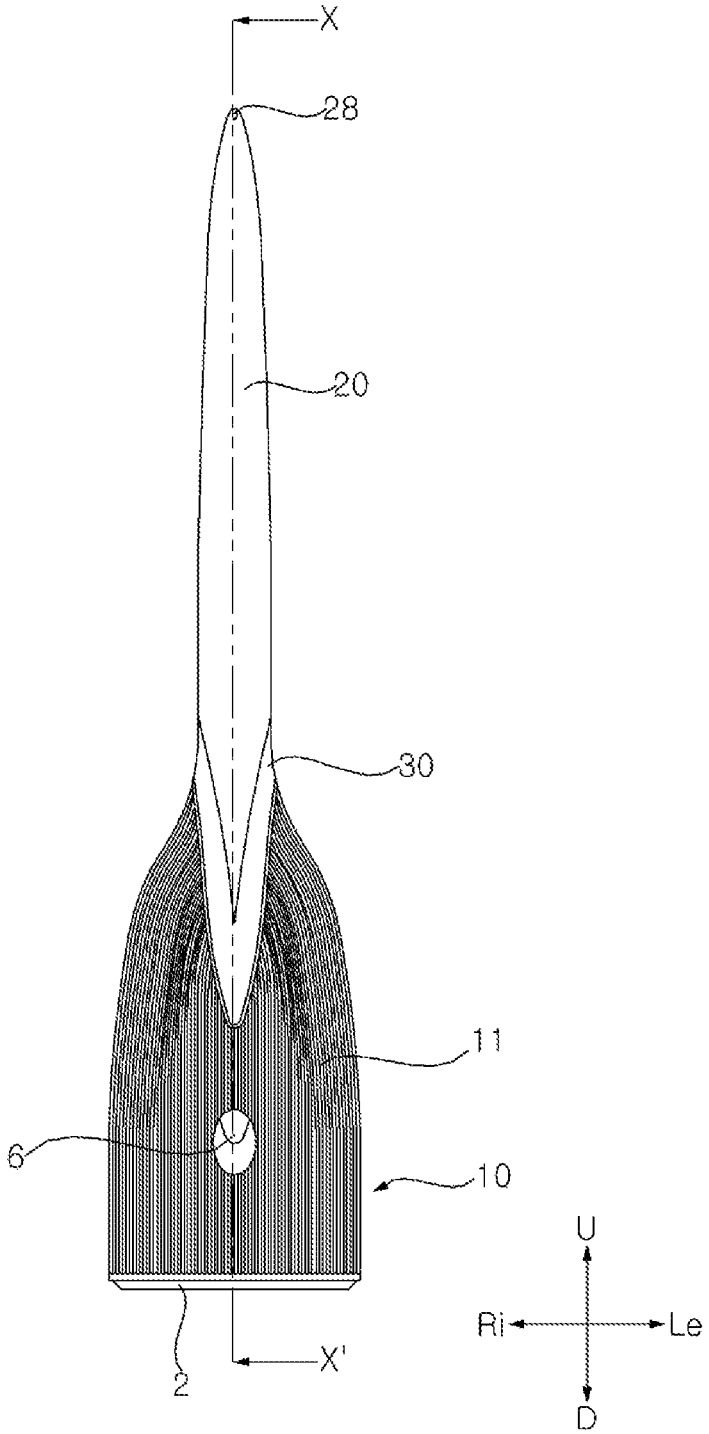
FIG. 2 is a front view of the blower according to an embodiment of the present disclosure.

Referring to FIGS. 1 and 2, a blower 1 may be elongated in the up-down direction. The blower 1 may have a base 1, a lower body 10, an upper body 20, and a side body 30.

The base 2 forms the bottom of the blower 1 and may be placed on the floor of an interior. The base 2 may be formed entirely in a circular plate shape.

The lower body 10 may be disposed over the base 2. The lower body 10 may form the lower portion of the side of the blower 1. For example, the diameter of the lower body 10 may decrease upward from the lower portion of the lower body 10. The lower body 10 may be formed entirely in a bell shape. Alternatively, the diameter of the lower body 10 may be constant in the up-down direction. In this case, the lower body 10 may be formed entirely in a cylinder shape.

A suction hole 11 may be formed on a side of the lower body 10. A plurality of suction holes 11 may be uniformly formed on the outer circumferential surface of the lower body 10 in the circumferential direction of the lower body 10. Accordingly, air can flow into the blower 1 from the outside through the plurality of suction holes 11. For example, the suction holes 11 may be elongated in the up-down direction.

The upper body 20 may be disposed over the lower body 10. The upper body 20 may form the upper portion of the side of the blower 1. The side of the upper body 20 may be a curved surface. The front-rear length of the upper body 20 may be larger than the left-right width of the upper body 20. In this case, the lower body 20 may be formed entirely in a leaf shape.

Meanwhile, the left side of the upper body 20 may be referred to as a first surface and the right side may be referred to as a second surface. Further, the first surface may be a curved surface that is convex to the left and the second surface may be a curved surface that is convex to the right.

The side body 30 may be disposed between the lower body 10 and the upper body 20. The side body 30 may form the center portion of the side of the blower 1. For example, the side body 30 may be formed in a wedge shape that is convex downward. The side body 30 may cover a portion of the upper body 20. For example, the side of the side body 30 may be a curved surface smoothly connecting the side of the lower body 10 and the side of the upper body 20.

Figure 3:
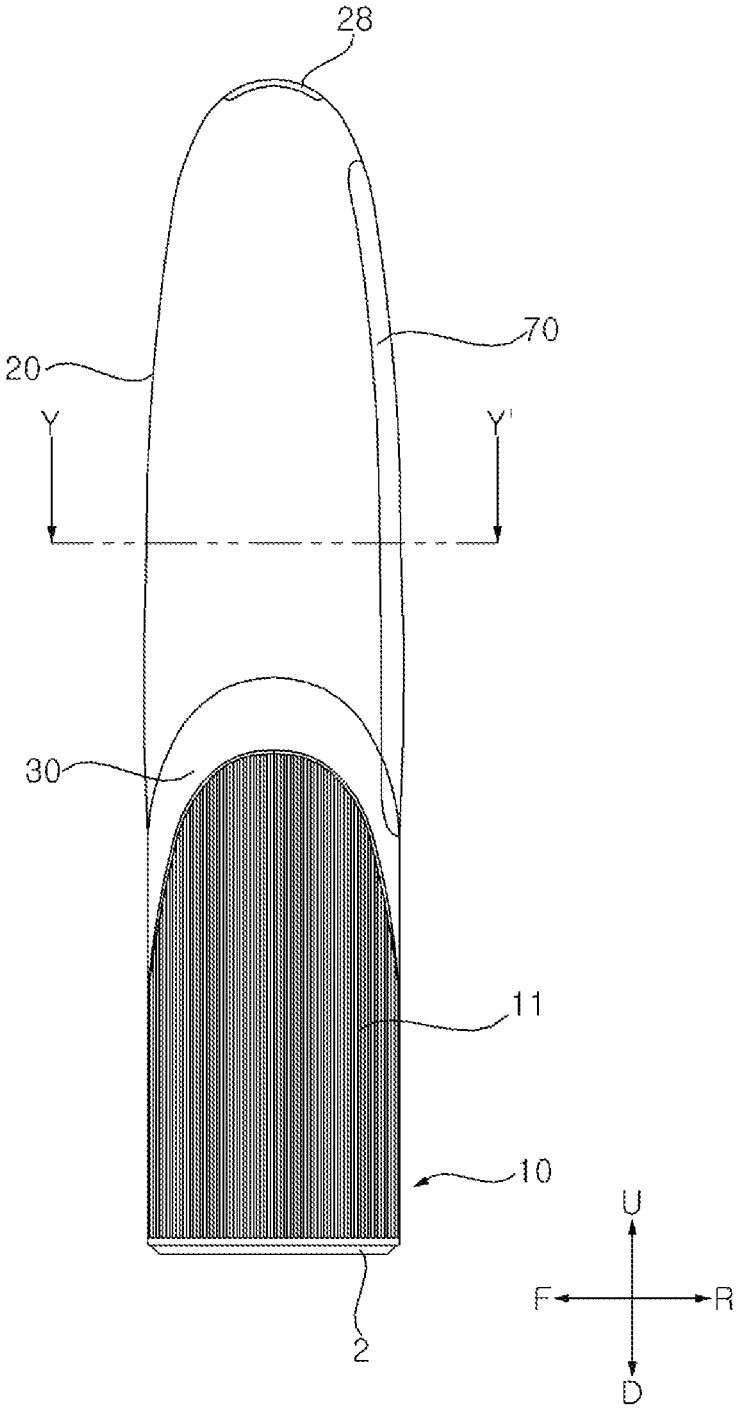
FIG. 3 is a left side view of the blower according to an embodiment of the present disclosure.

Referring to FIGS. 1 to 3, a damper 70 may be positioned behind the upper body 20. The damper 70 may be coupled to the rear of the upper body 20 to be movable in the front-rear direction, which will be described in detail below. For example, the outer surface of the damper 70 may have the same curvature as the outer surface of the upper body 20. That is, when the damper 70 comes in contact with the upper body 20, the outer surface of the damper 70 and the outer surface of the upper body 20 may be smoothly connected.

A display 6 may be disposed on the front surface of the lower body 10. For example, the display 6 can display operation information of the blower 1 such as the direction, speed, blowing mode, or the like of air that is discharged from the blower 1.

An input unit 28 may be provided at the upper end of the upper body 20. For example, a user can input instructions for adjusting the direction, speed, blowing mode, or the like of air, which is discharged from the blower 1, to the blower 1 through the input unit 28. For example, the input unit 28 may include a touch panel that receives instructions from a user. Meanwhile, the input unit 28 may be referred to as an interface unit.

Figure 4:
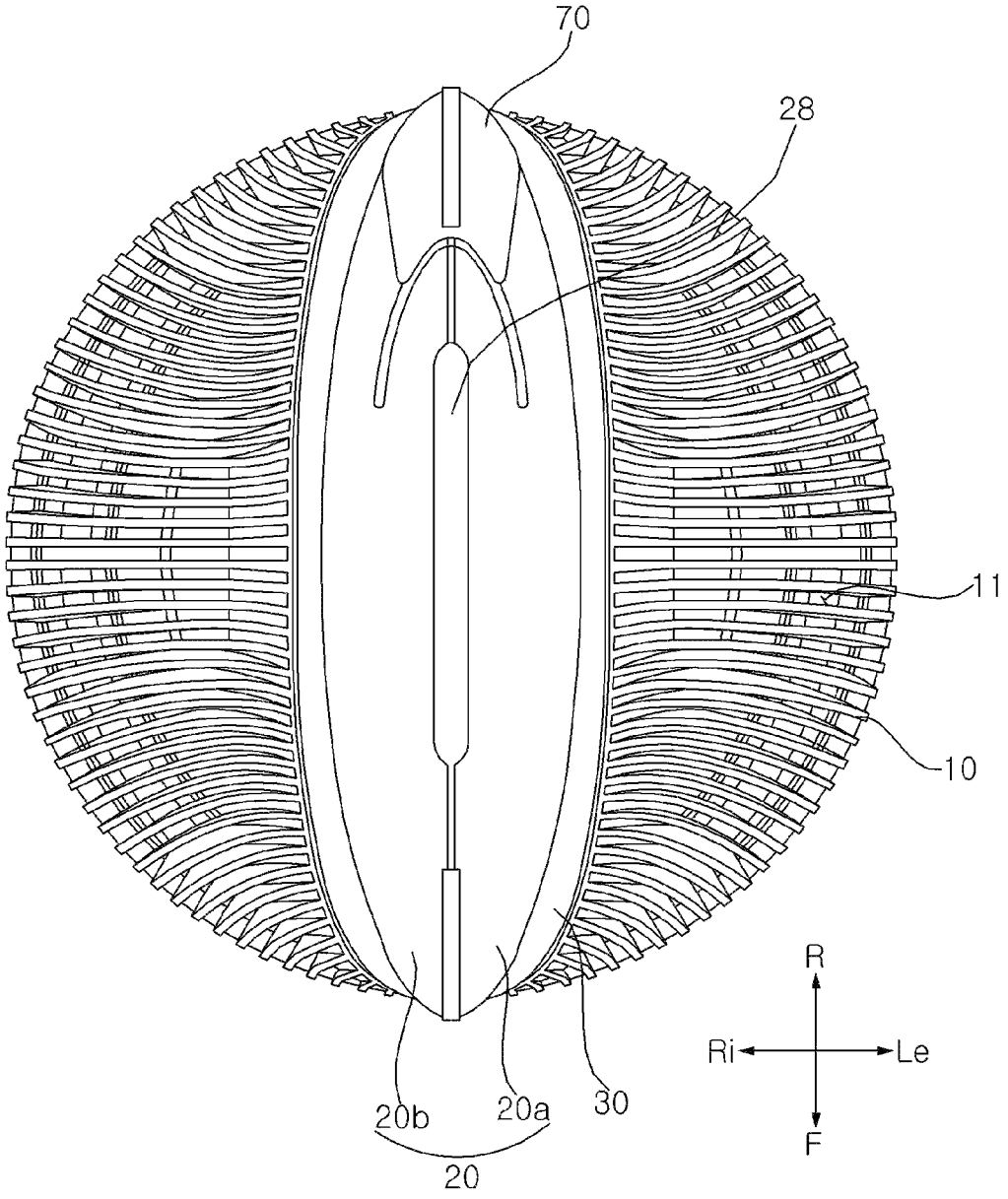
FIG. 4 is a plan view of the blower according to an embodiment of the present disclosure.

Referring to FIG. 4, the front-rear length of the upper body 20 may be the same as or larger than the diameter of the lower body 10. The left-right width of the upper body 20 may be smaller than the diameter of the lower body 10. For example, the left-right width of the upper body 20 may be smaller than ⅓ of the diameter of the lower body 10.

Figure 5:
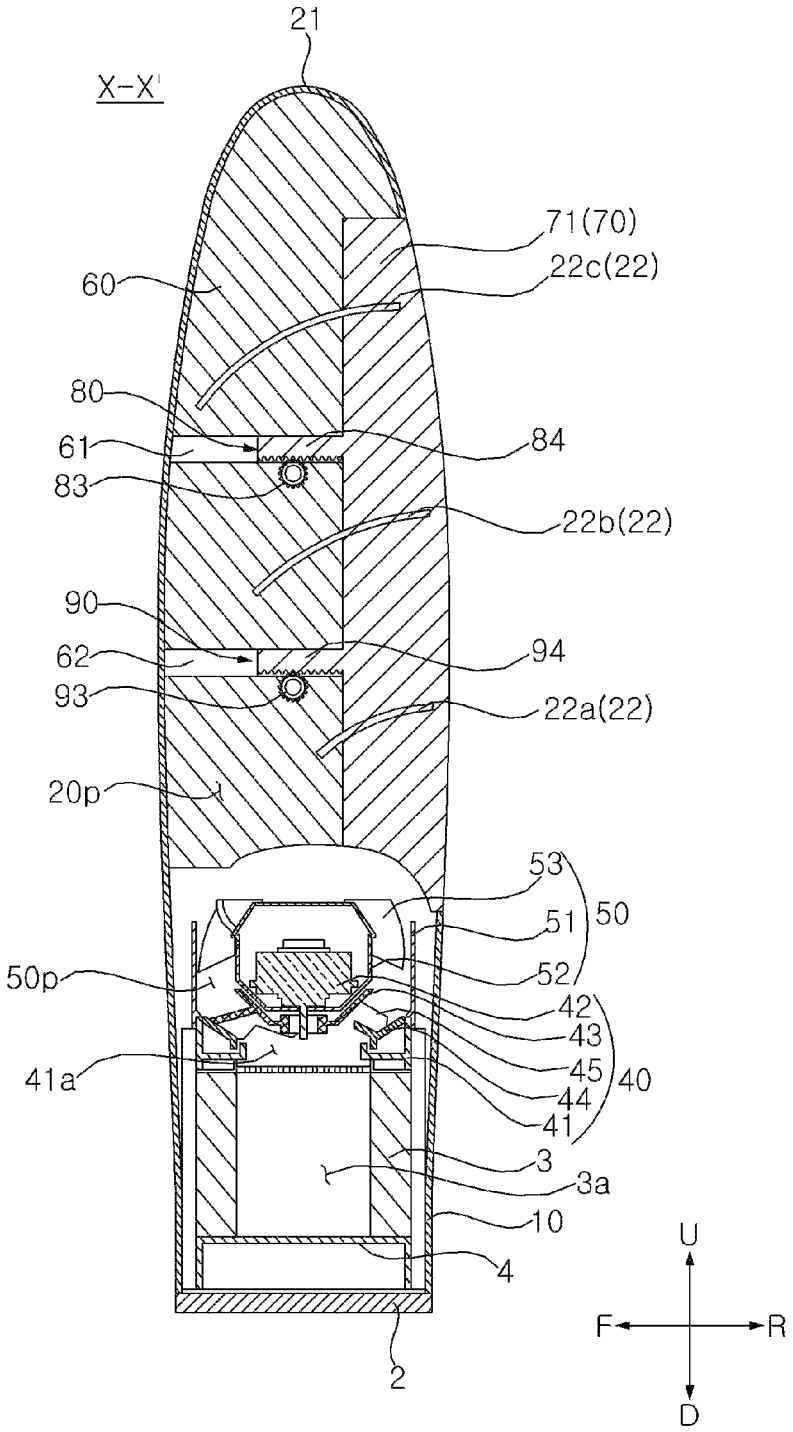
FIG. 5 shows a cross-section taken along line X-X' of FIG. 2.

Referring to FIG. 5, the lower body 10 may provide an internal space in which a filter 3, a controller 4, a fan 40, and an air guide 50 that will be described below are disposed.

The filter 3 may be separably installed in the internal space of the lower body 10. The filter 3 may be formed entirely in a cylinder shape. That is, the filter 3 may include a hole 3*a* formed through the filter 3 in the up-down direction. In this case, indoor air can flow into the lower body 10 through the suction holes 11 (see FIG. 1) by operation of the fan 40 to be described below. The indoor air flowing in the lower body 10 may be purified while flowing from the outer circumferential surface to the inner circumferential surface of the filter 3 and may flow upward through the hole 3*a*.

The controller 4 may be installed in the internal space of the lower body 10. For example, the controller 4 may be disposed between the base 2 and the filter 3. The controller 4 can control operation of the blower 1. Meanwhile, the flow of air passing through the filter 3 described above may be used also for cooling the controller 4 having a heat generation element.

The fan 40 can generate flow of air that flows into the blower 1 or is discharged from the blower 1 to the outside. The fan 40 may be installed in the internal space of the lower body 10. The fan 40 may be disposed over the filter 3. The fan 40 may include a fan housing 1, a fan motor 42, a hub 43, a shroud 44, and a blade 45. Meanwhile, the fan 40 may be referred to as a fan module.

The fan housing 41 may form the external shape of the fan 40. The fan housing 41 may include a hole formed through the fan housing 41 in the up-down direction. An intake port 41*a* may be formed at the lower end of the fan housing 41. In this case, the intake port 41*a* may be a bell mouth.

The fan motor 42 can provide a rotational force. The fan motor 42 may be a centrifugal fan or mixed-flow fan motor. The fan motor 42 may be supported by a motor cover 52 to be described below. In this case, the rotary shaft (not indicated by reference numeral) of the fan motor 42 may extend downward through the bottom of the motor cover 52 from the fan motor 42. The hub 43 is coupled to the rotary shaft and can rotate with the rotary shaft. The shroud 44 may be spaced apart from the hub 43. A plurality of blades 45 may be disposed between the shroud 44 and the hub 43.

Accordingly, when the fan motor 42 is driven, air can be suctioned inside in the axial direction of the fan motor 42 (that is, the longitudinal direction of the rotary shaft) through the intake port 41*a* and can be discharged in the radial direction of the fan motor 42 (that is, the radial direction of the hub 43) and upward from the fan motor 42.

Meanwhile, the air guide 50 can provide a channel 50*p* through which the air discharged from the fan 40 flows. For example, the channel 50*p* may be an annular channel. The air guide 50 may include a guide body 51, a motor cover 52, and vanes 53.

The guide body 51 may form the external shape of the air guide 50. The motor cover 52 may be disposed at the middle portion of the air guide 50. For example, the guide body 51 may be formed in a cylinder shape. Further, the motor cover 52 may be formed in a bowl shape. In this case, the annular channel 50*p* described above may be formed between the guide body 51 and the motor cover 52. The vane 53 can guide upward the air provided to the channel 50*p* from the fan 40. A plurality of vanes 53 may be disposed in the annular channel 50*p* and may be spaced apart from each other in the circumferential direction of the guide body 51. In this case, the plurality of vanes 53 each may extend to the inner circumferential surface of the guide body 51 from the outer surface of the motor cover 52.

Meanwhile, the upper body 20 may provide channels 20*p* and 20*q* through which air that has passed through the air guide 50 flows. That is, the air that has passed through the air guide 50 can flow up through the channels 20*p* and 20*q*.

Figure 6:
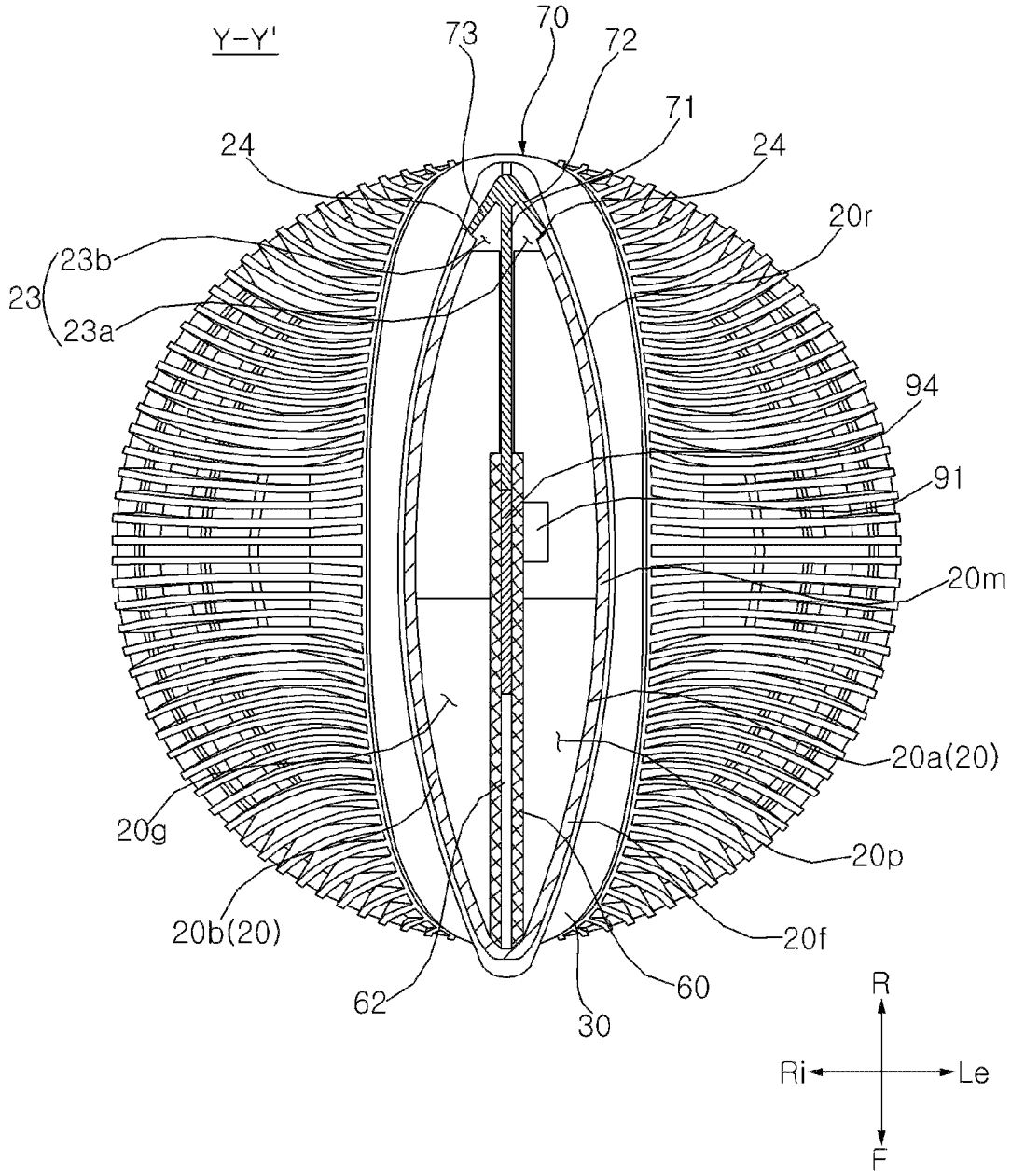
FIG. 6 is a cross-sectional view taken along line Y-Y' of FIG. 3.

Referring to FIGS. 5 and 6, the upper body 20 may be divided into a rear part 20*r*, a front part 20*f*, and a middle part 20*m* in the front-rear direction. The rear part 20*r* may extend forward while forming the rear end of the upper body 20. In this case, the left-right width of the rear part 20*r* may increase forward. The front part 20*f* may extend rearward while forming the front end of the upper body 20. In this case, the left-right width of the front part 20*f* may increase rearward. The middle part 20*m* may be positioned between the rear part 20*r* and the front part 20*f*. In this case, the middle part 20*m* may be connected or coupled to the front end of the rear part 20*r* and the rear end of the front part 20*f*. In other words, the left-right width of the middle part 20*m* may be the maximum width of the upper body 20. Meanwhile, the middle part 20*m* may be positioned at the middle of the upper body 20, ahead of the middle, or behind the middle in the front-rear direction.

For example, the upper body 20 may include a first upper body 20*a* and a second upper body 20*b* that are combined with each other. In this case, the first upper body 20*a* may form the left side of the upper body 20 and the second upper body 20*b* may form the right side of the upper body 20. Further, the shape of the first upper body 20*a* and the shape of the second upper body 20*b* may symmetric in the left-right direction. In this case, the rear part 20*r*, the front part 20*f*, and the middle part 20*m* may be formed at each of the first upper body 20*a* and the second upper body 20*b*.

Meanwhile, the upper end 21 of the upper body 20 may have an upwardly convex shape. In this case, the upper end 21 can guide air flowing up in the internal space of the upper body 20 to an opening 23 to be described below.

A separation wall 60 is disposed in the internal space of the upper body 20, thereby being able to divide the internal space of the upper body 20 into a first space (not indicated by reference numeral) and a second space (not indicated by reference numeral). The separation wall 60 may be fixed to the inner surface of the upper body 20. The separation wall 60 is a vertical plate elongated in the up-down direction and may be in contact with the inner surface of the upper body 20. For example, the separation wall 60 may be disposed at the center of the internal space of the upper body 20 in the left-right direction. The first space may be positioned at the left of the separation wall 60 and may form the first channel

20*p*. The second space may be positioned at the right of the separation wall 60 and may form the second channel 20*q*.

The damper 70 may be installed in the internal space of the upper body 20. The damper 70 may be coupled to the rear of the separation wall 60 to be movable in the front-rear direction. The damper 70 may be elongated in the up-down direction and may be disposed in parallel with the separation wall 60 in the front-rear direction. In this case, the boundary of the first channel 20*p* may be defined by the separation wall 60, the damper 70, and the upper body 20 at the left of the separation wall 60. Further, the boundary of the second channel 20*q* may be defined by the separation wall 60, the damper 70, and the upper body 20 at the right of the separation wall 60.

Accordingly, some of air that has passed through the air guide 50 can flow through the first channel 20*p* and the other can flow through the second channel 20*q*.

Meanwhile, the opening 23 is formed at the rear end of the upper body 20 and may communicate with the first channel 20*p* and the second channel 20*q*. In detail, the opening 23 may be formed and elongated in the up-down direction between the rear end 24 of the rear part 24*r* of the first upper body 20*a* and the rear end 24 of the rear part 24*r* of the second upper body 20*b*. Accordingly, the air flowing through the first channel 20*p* and the second channel 20*q* can be discharged rearward from the upper body 20 through the opening 23.

The vane 22 may be coupled to the left side and/or the right side of the separation wall 60. The vane 22 coupled to the left side of the separation wall 60 can guide rearward air flowing up in the first channel 20*p*. The vane 22 coupled to the right side of the separation wall 60 can guide rearward air flowing up in the second channel 20*q*. The vane 22 may have an upwardly convex shape. The vane 22 may include a plurality of vanes 22*a*, 22*b*, and 22*c* spaced apart from each other in the up-down direction. In this case, the lengths of the plurality of vanes 22*a*, 22*b*, and 22*c* may be different. For example, the vane positioned relatively upward of the plurality of vanes 22*a*, 22*b*, and 22*c* may be larger in length than the vane positioned relatively downward. The rear end of each of the plurality of vanes 22*a*, 22*b*, and 22*c* may be spaced forward apart from the opening 23. For example, the plurality of vanes 22*a*, 22*b*, and 22*c* each may be partially disposed on the left side and/or the right side of the damper 70.

The damper 70 described above may include a plate 71, a first guide 72, and a second guide 73.

The plate 72 may be disposed in parallel with the separation wall 60 in the front-rear direction. The plate 71 may separate the first space and the second space in cooperation with the separation wall 60. That is, the left side of the plate 71 and the left side of the separation wall 60 may define a portion of the boundary of the first channel 20*p*, and the right side of the plate 71 and the right side of the separation wall 60 may define a portion of the boundary of the second channel 20*q*.

Further, the plate 71 may extend rearward through the opening 23 from the separation wall 60. In this case, the plate 71 may divide the opening 23 into a first opening 23*a* positioned at the left of the plate 71 and a second opening 23*b* positioned at the right of the plate 71. The first opening 23*a* may be formed between the rear end 24 of the rear part 20*r* of the first upper body 20*a* and the plate 71 and may communicate with the first channel 20*p*. The second opening 23*b* may be formed between the rear end 24 of the rear part 20*r* of the second upper body 20*b* and the plate 71 and may communicate with the second channel 20*q*.

The first guide 72 may extend left and forward at an angle from the rear end of the plate 71. That is, the angle between the first guide 72 and the plate 71 may be an acute angle. For example, the inner surface of the first guide 72 may be a curved surface. The first guide 72 can come in contact with or separate rearward from the rear end 24 of the rear part 20*r* of the first body 20*a* while moving in the front-rear direction together with the plate 71 described above, which will be described in detail below. In this case, the front end of the first guide 72 may overlap the rear end 24 of the first upper body 20*a* in the front-rear direction.

The second guide 73 may extend right and forward at an angle from the rear end of the plate 71. That is, the angle between the second guide 73 and the plate 71 may be an acute angle. For example, the inner surface of the second guide 73 may be a curved surface. The second guide 73 can come in contact with or separate rearward from the rear end 24 of the rear part 20*r* of the second body 20*b* while moving in the front-rear direction together with the plate 71 described above, which will be described in detail below. In this case, the front end of the second guide 73 may overlap the rear end 24 of the second upper body 20*b* in the front-rear direction.

The first guide 72 and the second guide 73 may be formed in a wedge shape that is entirely convex rearward. That is, the gap between the first guide 72 and the second guide 73 may increase forward.

The outer surface of the first guide 72 and the outer surface of the second guide 73 are curved surfaces and may form the outer surface of the damper 70. In this case, when the first guide 72 and the second guide 73 come in contact with the upper body 20, the outer surface of the first guide 72 and the outer surface of the second guide 73 may be smoothly connected with the outer surface of the upper body 20.

The damper 70 described above can be moved in the front-rear direction by moving assemblies 80 and 90 to be described below. For example, the moving assemblies 80 and 90 may include a first moving assembly 80 and a second moving assembly 90 that are spaced apart from each other in the up-down direction. Meanwhile, the moving assemblies 80 and 90 may be configured as a single moving assembly or may be composed of three or more moving assemblies.

The first moving assembly 80 may include a first motor 81, a first pinion 83, and a first rack 84.

The first motor 81 can provide a rotational force. The first motor 81 can adjust the rotational direction, rotation angle, and rotation speed of the rotary shaft of the first motor 81. For example, the first motor 81 may be a step motor. The first motor 81 may be installed on the left side or the right side of the separation wall 60 through a first bracket (not shown).

The first pinion 83 is coupled to the rotary shaft of the first motor 81 and can rotate with the rotary shaft. The first pinion 83 may be engaged with the first rack 84 from above or under the first rack 84 to be described below.

The first rack 84 may extend forward from the front end of the plate 71. The first rack 84 is engaged with the first pinion 83 and can move forward or rearward, depending on the rotational direction of the first pinion 83. In this case, the separation wall 60 may include a first slot 61 that is elongated in the front-rear direction and in which the first rack 84 is inserted to be movable in the front-rear direction. That is, the first slot 61 can guide the first rack 84 moving in the front-rear direction and can restrict up-down and/or left-right movement of the first rack 84.

The second moving assembly 90 may include a second motor 91, a second pinion 93, and a second rack 94. In this case, the second moving assembly 90 may be positioned under the first moving assembly 80.

The second motor 91 can provide a rotational force. The second motor 91 can adjust the rotational direction, rotation angle, and rotation speed of the rotary shaft of the second motor 91. For example, the second motor 91 may be a step motor. The second motor 91 may be installed on the left side or the right side of the separation wall 60 through a second bracket (not shown).

The second pinion 93 is coupled to the rotary shaft of the second motor 91 and can rotate with the rotary shaft. The second pinion 93 may be engaged with the second rack 94 from above or under the second rack 94 to be described below.

The second rack 94 may extend forward from the front end of the plate 71. The second rack 94 is engaged with the first pinion 93 and can move forward or rearward, depending on the rotational direction of the second pinion 93. In this case, the separation wall 60 may include a second slot 62 that is elongated forward and rearward and in which the second rack 94 is inserted to be movable forward and rearward. That is, the second slot 62 can guide the second rack 94 moving in the front-rear direction and can restrict up-down and/or left-right movement of the second rack 94.

Accordingly, when the first motor 81 and the second motor 91 are driven, the first rack 84, the second rack 94, and the damper 70 coupled to the racks can move forward or rearward. In this case, forward movement of the damper 70 may be restricted by the first guide 72 and the second guide 73 coming in contact with the upper body 20. Further, rearward movement of the damper 70 may be restricted by the first pinion 83 and the second pinion 93 coming in contact with stoppers at the front ends of the first rack 84 and the second rack 94, respectively.

Figure 7A:
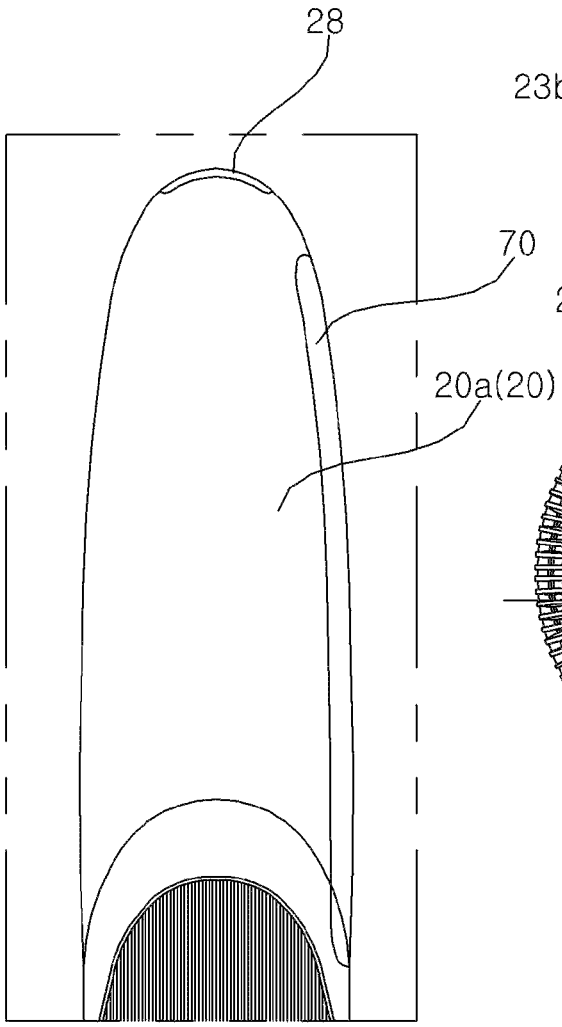
FIG. 7(*a*) is a view illustrating a first position of a damper.
Figure 7B:
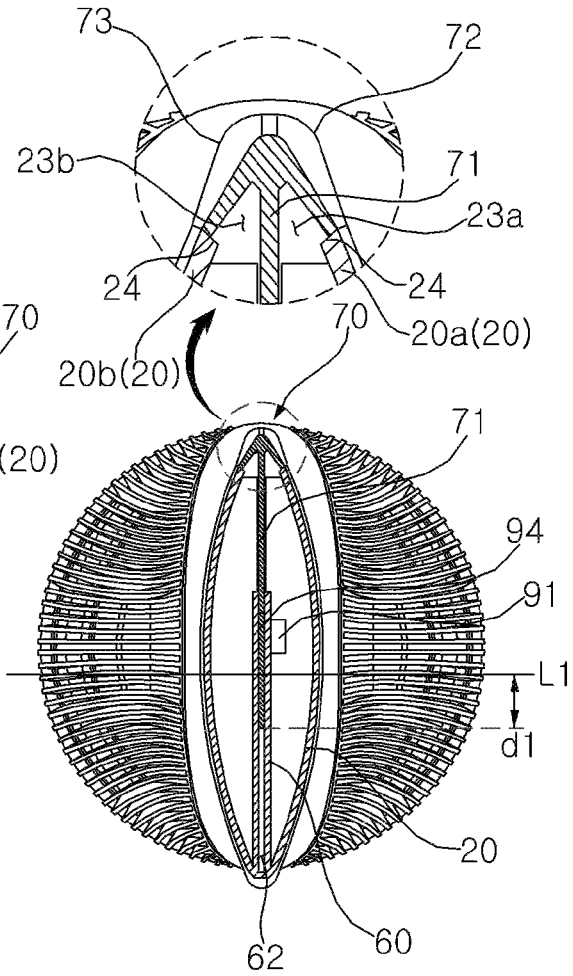

Referring to FIG. 7, when the damper 70 is at a first position or in a first state, the first guide 72 and the second guide 73 may be in contact with the upper body 20.

In detail, the front end of the first guide 72 may be in contact with the rear end 24 of the rear part 20*r* of the first upper body 20*a* and the front end of the second guide 73 may be in contact with the rear end 24 of the rear part 24*r* of the second upper body 20*a*.

To this end, it is possible to control the first rack 84 (see FIG. 5) and the second rack 94 to be positioned foremost in the first slot 61 (see FIG. 5) and the second slot 62 by adjusting operation of the first motor 81 (see FIG. 5) and the second motor 92 described above. In this case, the front end of the first rack 84 and the front end of the second rack 94 may be positioned at a first distance d1 forward from a virtual line L1 that extends in the left-right direction while passing through the center of the upper body 20.

Accordingly, first and second discharge ports 72*a* and 73*a* (see FIGS. 8 and 9) are not formed and the air flowing in the upper body 20 may not be discharged out of the upper body 20. That is, it may be preferable that operation of the fan 40 described above is stopped when the damper 70 is at the first position or in the first state. Meanwhile, this state may be referred to as an off-mode of the blower 1.

Figure 8A:
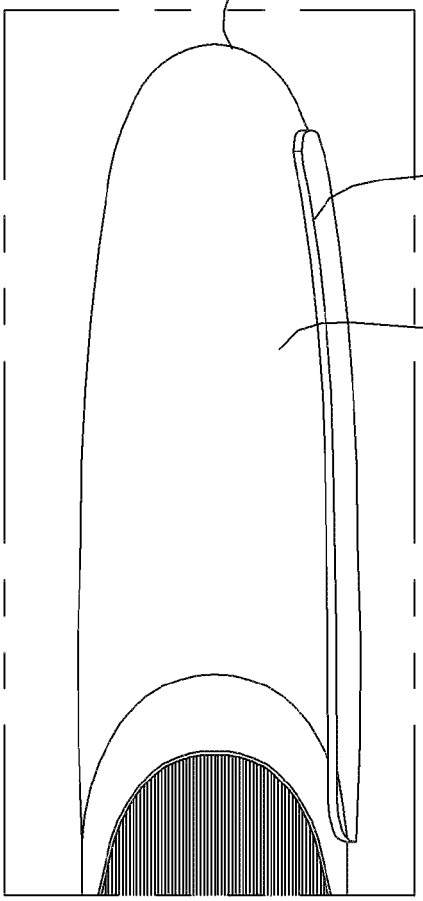
FIG. 8(*a*) is a view illustrating a second position of the damper.
Figure 8B:
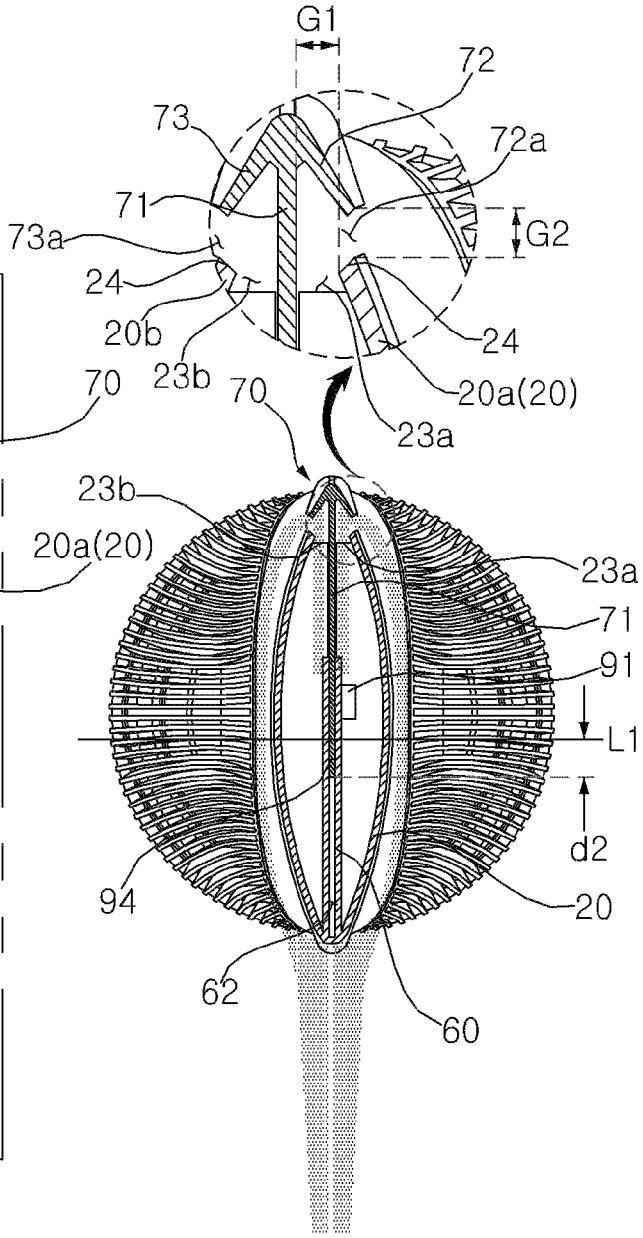

Referring to FIG. 8, when the damper 70 is at a second position or in a second state, the first guide 72 and the second guide 73 may be spaced rearward apart from the upper body 20.

In detail, the front end of the first guide 72 may be spaced rearward apart from the rear end 24 of the rear part 24*r* of the first upper body 20*a*. In this case, a first discharge port 72*a* that communicates with the first opening 23*a* may be formed between the front end of the first guide 72 and the rear end 24 of the first upper body 20*a*. The front end of the second guide 73 may be spaced rearward apart from the rear end 24 of the rear part 24*r* of the second upper body 20*b*. In this case, a second discharge port 73*a* that communicates with the second opening 23*a* may be formed between the front end of the second guide 73 and the rear end 24 of the second upper body 20*b*.

To this end, it is possible to control the first rack 84 (see FIG. 5) and the second rack 94 to be moved rearward a predetermined distance in the first slot 61 (see FIG. 5) and the second slot 62 in comparison to the first position of the damper 70 described above by adjusting operation of the first motor 81 (see FIG. 5) and the second motor 92 described above. In this case, the front end of the first rack 84 and the front end of the second rack 94 may be positioned at a second distance d2 forward from the virtual line L1. In this case, the second distance d2 may be smaller than the first distance d1 (see FIG. 7).

Further, the left-right width G1 of the first opening 23*a* may be defined as the gap between the left side of the plate 71 and the rear end 24 of the first upper body 20*a*. Similarly, the left-right width G2 of the second opening 23*b* may be defined as the gap between the right side of the plate 71 and the rear end 24 of the second upper body 20*b*.

Further, the front-rear gap G2 of the first discharge port 72*a* may be defined as the gap between front end of the first guide 72 and the rear end 24 of the first upper body 20*a*. Similarly, the front-rear gap G2 of the second discharge port 73*a* may be defined as the gap between front end of the second guide 72 and the rear end 24 of the second upper body 20*b*.

In this case, the gaps G2 of the first and second discharge ports 72*a* and 73*a* may be the same as or smaller than the widths G1 of the first and second openings 23*a* and 23*b*. The cross-sectional area of an air channel may gradually decrease in the flow direction of air flowing to the first and second discharge ports 72*a* and 73*a* through the first and second openings 23*a* and 23*b*. That is, the first guide 72 and the second guide 73 guide the air, which has passed through the first opening 23*a* and the second opening 23*b*, to the outer surface of the upper body 20, thereby being able to increase the flow speed of the air.

Accordingly, when the fan motor 42 (see FIG. 5) is driven, air can be discharged to the outer surface of the upper body 20 from the first discharge port 72*a* and the second discharge port 73*a*. Further, the air discharged to the outer surface of the upper body 20 can flow forward along the outer surface of the upper body 20 due to Coanda Effect (see the shaded part in FIG. 8). Further, such flow of air can generate airflow of air moving forward from the rear around the upper body 20. Meanwhile, this state may be referred to as an intensive blow mode of the blower 1.

Figure 9A:
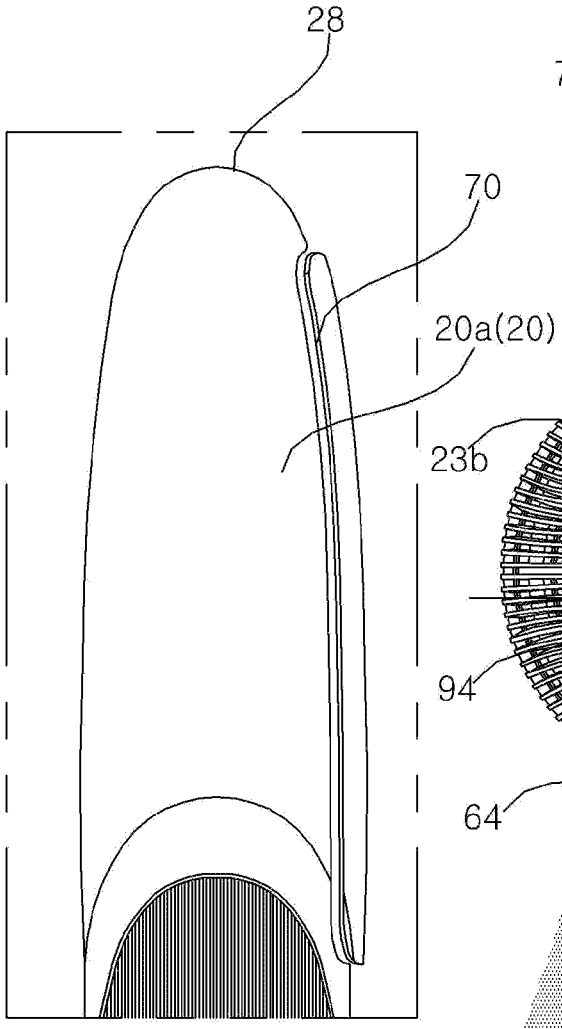
FIG. 9(*a*) is a view illustrating a third position of the damper.
Figure 9B:
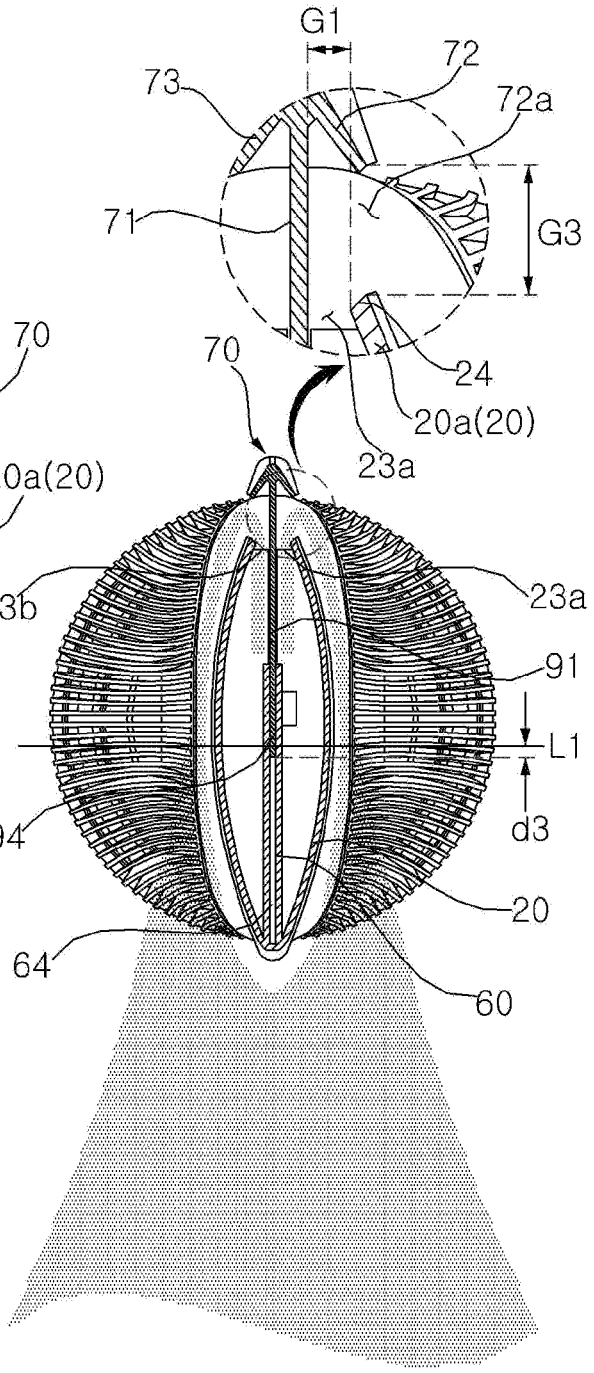

Referring to FIG. 9, when the damper 70 is at a third position or in a third state, the first guide 72 and the second guide 73 may be spaced rearward apart from the upper body 20.

In detail, the front end of the first guide 72 may be spaced rearward apart from the rear end 24 of the rear part 24*r* of the first upper body 20*a*. In this case, a first discharge port 72*a* that communicates with the first opening 23*a* may be formed between the front end of the first guide 72 and the rear end 24 of the first upper body 20*a*. The front end of the second guide 73 may be spaced rearward apart from the rear end 24 of the rear part 24*r* of the second upper body 20*b*. In this case, a second discharge port 73*a* that communicates with the second opening 23*a* may be formed between the front end of the second guide 73 and the rear end 24 of the second upper body 20*b*.

To this end, it is possible to control the first rack 84 (see FIG. 5) and the second rack 94 to be moved rearward a predetermined distance in the first slot 61 (see FIG. 5) and the second slot 62 in comparison to the second position of the damper 70 described above by adjusting operation of the first motor 81 (see FIG. 5) and the second motor 92 described above. In this case, the front end of the first rack 84 and the front end of the second rack 94 may be positioned at a second distance d3 forward from the virtual line L1. In this case, the third distance d2 may be smaller than the second distance d2 (see FIG. 8).

Further, the left-right width G1 of the first opening 23*a* may be defined as the gap between the left side of the plate 71 and the rear end 24 of the first upper body 20*a*. Similarly, the left-right width G2 of the second opening 23*b* may be defined as the gap between the right side of the plate 71 and the rear end 24 of the second upper body 20*b*.

Further, the front-rear gap G3 of the first discharge port 72*a* may be defined as the gap between front end of the first guide 72 and the rear end 24 of the first upper body 20*a*. Similarly, the front-rear gap G3 of the second discharge port 73*a* may be defined as the gap between front end of the second guide 72 and the rear end 24 of the second upper body 20*b*.

In this case, the gaps G3 of the first and second discharge ports 72*a* and 73*a* may be larger than the widths G1 of the first and second openings 23*a* and 23*b*. That is, since the first guide 72 and the second guide 73 are positioned relatively far from the outer surface of the upper body 20, the amount of air that is guided to the outer surface of the upper body 20 by the first guide 72 and the second guide 73 can be relatively decreased.

Accordingly, when the fan motor 42 (see FIG. 5) is driven, only some of the air that has passed through the first opening 23*a* and the second opening 23*b* can be discharged to the outer surface of the upper body 20. That is, in comparison to the second position of the damper 70, the air that is discharged from the blower 1 when the damper 70 is at the third position can flow forward while being distributed or spread in the left-right direction (see the shaded part in FIG. 9). Meanwhile, this state may be referred to as a spread blow mode of the blower 1.

Figure 10:
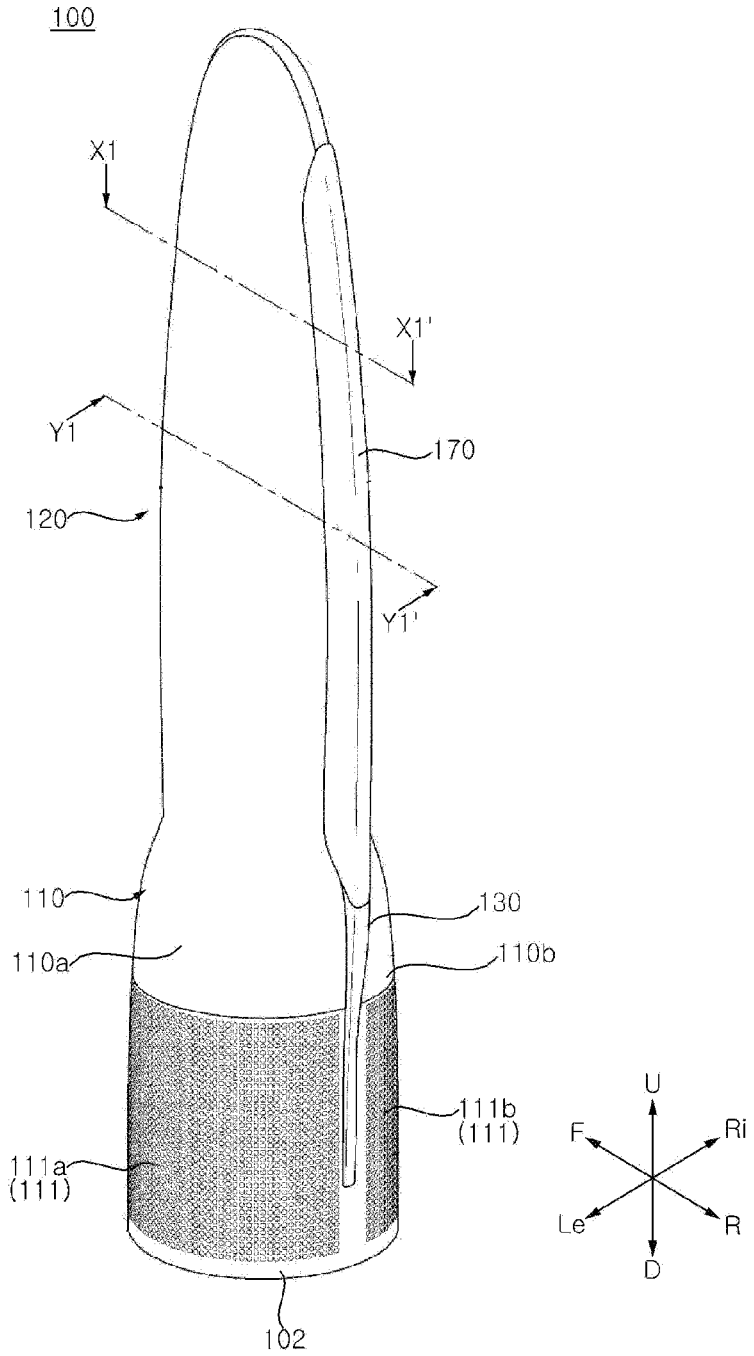
FIG. 10 is a perspective view of a blower according to another embodiment of the present disclosure.

Referring to FIG. 10, a blower 100 may be elongated in the up-down direction. The blower 100 may have a base 102, a lower body 110, an upper body 120, and a rear body 130.

The base 102 forms the bottom of the blower 100 and may be placed on the floor of an interior. The base 102 may be formed entirely in a circular plate shape.

The lower body 110 may form the lower portion of the side of the blower 100. For example, the diameter of the lower body 110 may decrease upward from the lower portion of the lower body 110. The lower body 110 may be formed entirely in a bell shape. Alternatively, the diameter of the lower body 110 may be constant in the up-down direction. In this case, the lower body 110 may be formed entirely in a cylinder shape.

For example, the upper body 110 may include a first upper body 110*a* and a second upper body 20*b* that are combined with each other in the left-right direction. In this case, any one of the first lower body 110*a* and the second lower body 110*b* may be separately coupled to the other one.

A suction hole 111 may be formed on a side of the lower body 110. A plurality of suction holes 111 may be uniformly formed on the outer surface of the lower body 110 in the circumferential direction of the lower body 110. Accordingly, air can flow into the blower 100 from the outside through the plurality of suction holes 111. For example, the suction holes 111 may be small holes. For example, the suction holes 111 may include a first suction hole 111*a* formed on the side of the first lower body 110*a* and a second suction hole 111*b* formed on the side of the second lower body 111*b*.

The upper body 120 may be disposed over the lower body 110. The upper body 120 may form the upper portion of the side of the blower 100. The side of the upper body 120 may be a curved surface. The front-rear length of the upper body 120 may be larger than the left-right width of the upper body 120. In this case, the lower body 120 may be formed entirely in a leaf shape.

Meanwhile, the left side of the upper body 120 may be referred to as a first surface and the right side may be referred to as a second surface. Further, the first surface may be a curved surface that is convex to the left and the second surface may be a curved surface that is convex to the right.

The rear body 130 may be coupled to the rear of the lower body 110. The rear body 130 may protrude rearward further than the outer surface of the lower body 110. The rear body 130 may be elongated in the up-down direction and the front-rear thickness of the rear body 130 may increase upward. For example, the rear body 130 can support the damper 170 to be described below from under the damper 170. Meanwhile, the rear body 130 may be referred to as a supporter.

Figure 11:
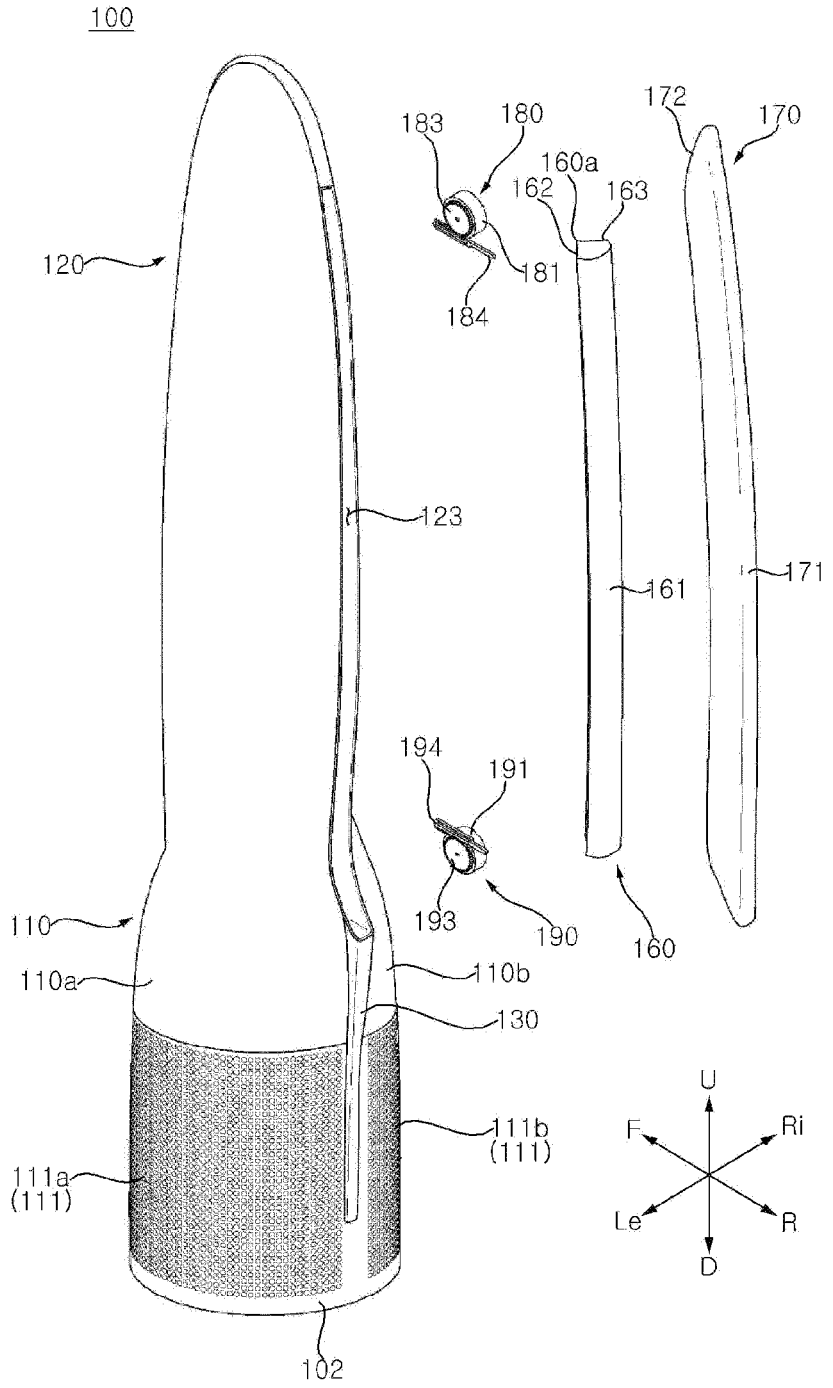
FIG. 11 is an exploded perspective view of the blower according to another embodiment of the present disclosure.

Referring to FIGS. 10 to 11, the damper 170 may be coupled to the rear of the upper body 120. In this case, the damper 170 may cover a portion of the upper body 120. Further, the damper 170 can be moved in the front-rear direction by moving assemblies 180 and 190 to be described below.

Meanwhile, the blower 100 may include the display 6 and the input unit 28 described above with reference to FIG. 1, etc.

Figure 12:
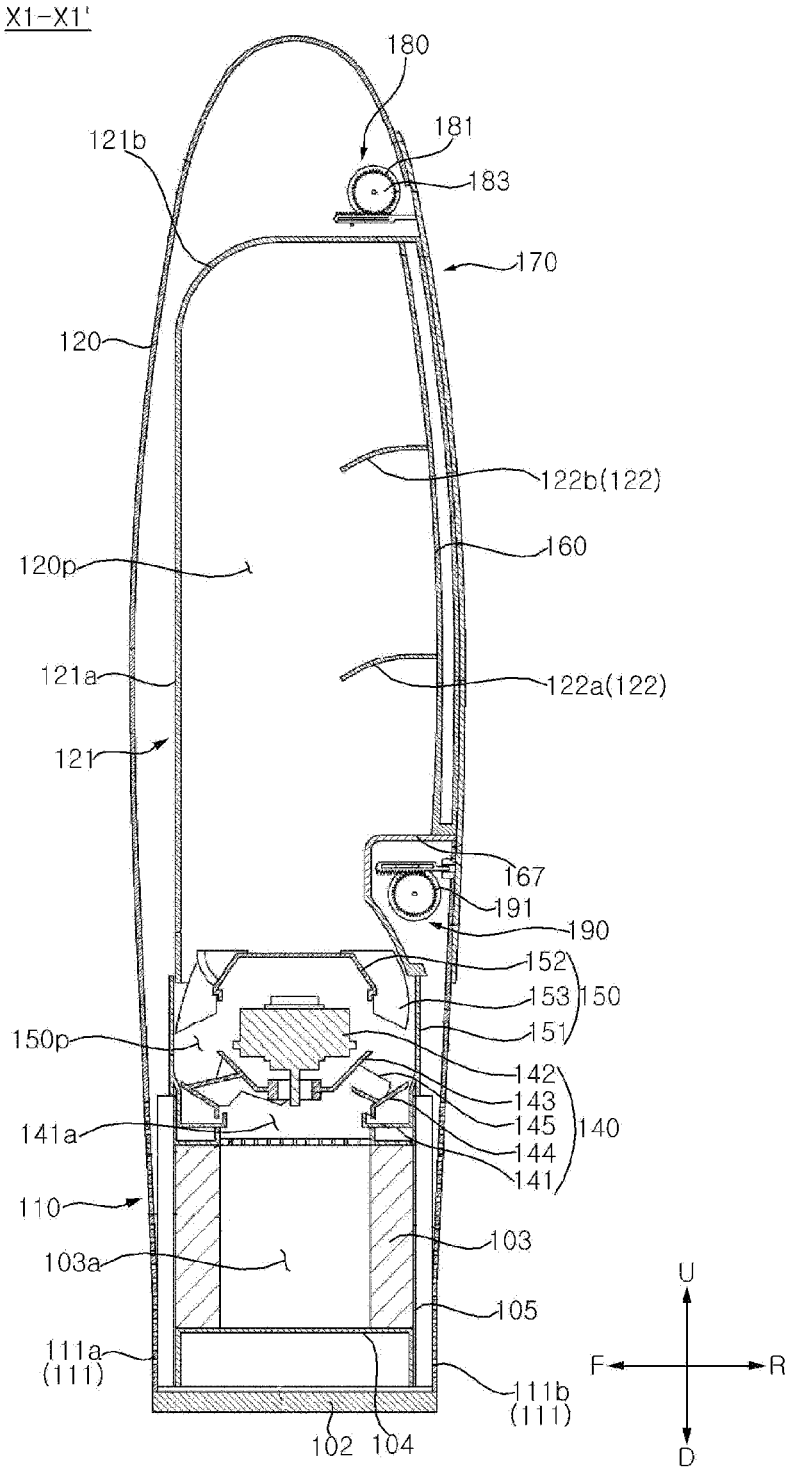
FIG. 12 shows a cross-section taken along line X1-X1' of FIG. 10.
Figure 13:
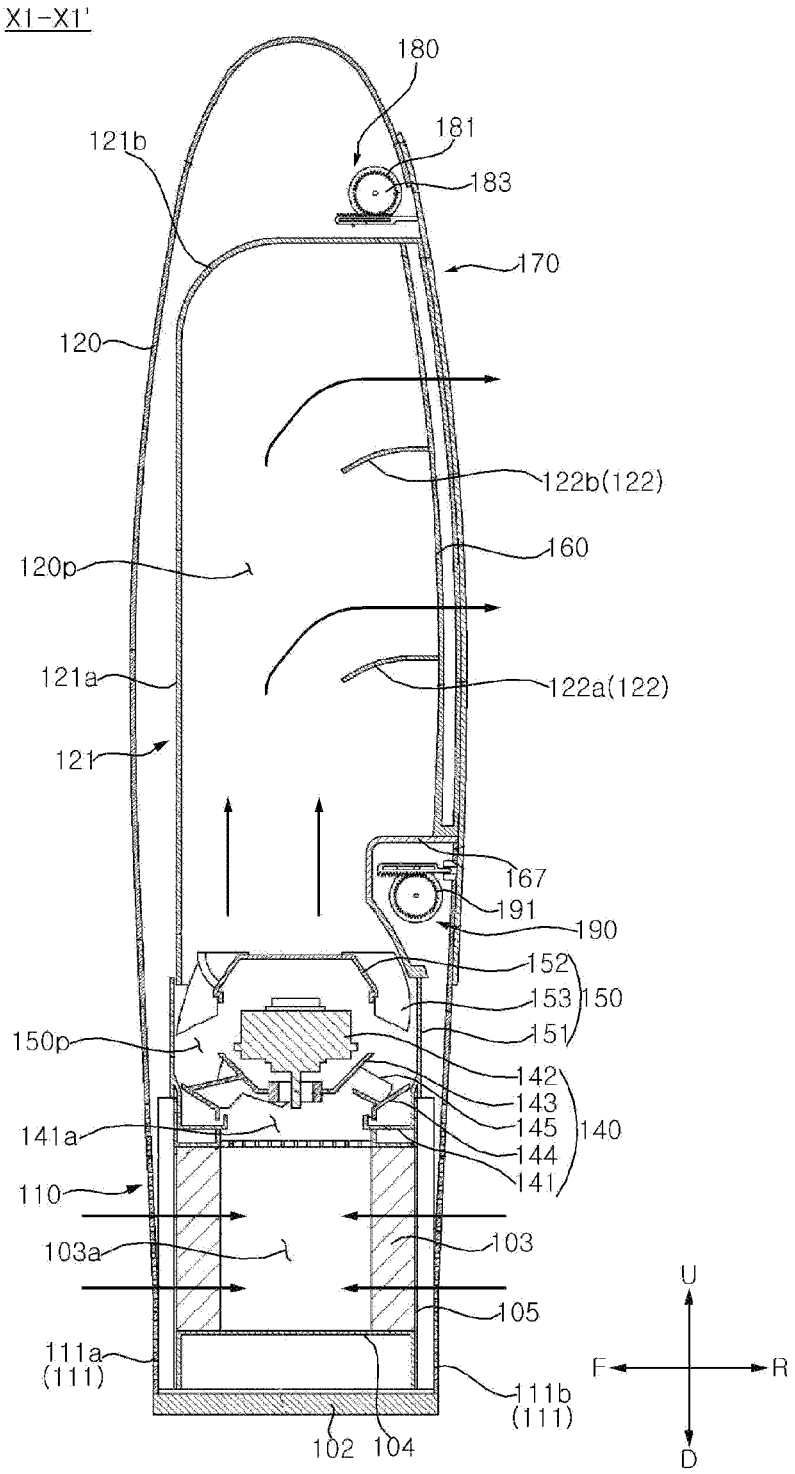
FIG. 13 is a view showing the section taken along line X1-X1' of FIG. 10 and illustrating a flow of air blown by a fan.

Referring to FIGS. 12 and 13, the lower body 110 may provide an internal space in which a filter 103, a controller 104, a fan 140, and an air guide 150 that will be described below are disposed.

The filter 103 may be separably installed in the internal space of the lower body 110. The filter 103 may be formed entirely in a cylinder shape. That is, the filter 103 may include a hole 103*a* formed through the filter 103 in the up-down direction. In this case, indoor unit can flow into the lower body 110 through the suction holes 111 by operation of the fan 140 to be described below. The indoor air flowing in the lower body 110 may be purified while flowing from the outer surface to the inner surface of the filter 103 and may flow upward through the hole 103*a* (see the arrows in FIG. 13).

The controller 104 may be installed in the internal space of the lower body 110. For example, the controller 104 may be disposed between the base 102 and the filter 103. The controller 104 can control operation of the blower 100. Meanwhile, the flow of air passing through the filter 103 described above may be used also for cooling the controller 104 having a heat generation element.

The fan 140 can generate flow of air that flows into the blower 100 or is discharged from the blower 100 to the outside. The fan 140 may be installed in the internal space of the lower body 110. The fan 140 may be disposed over the filter 103. The fan 140 may include a fan housing 141, a fan motor 142, a hub 143, a shroud 144, and a blade 145. Meanwhile, the fan 140 may be referred to as a fan module.

The fan housing 141 may form the external shape of the fan 140. The fan housing 141 may include a hole formed through the fan housing 141 in the up-down direction. An intake port 141*a* may be formed at the lower end of the fan housing 141. In this case, the intake port 141*a* may be a bell mouth.

The fan motor 142 can provide a rotational force. The fan motor 142 may be a centrifugal fan or mixed-flow fan motor. The fan motor 142 may be supported by a motor cover 152 to be described below. In this case, the rotary shaft (not indicated by reference numeral) of the fan motor 142 may extend downward through the bottom of the motor cover 152 from the fan motor 142. The hub 143 is coupled to the rotary shaft and can rotate with the rotary shaft. The shroud 144 may be spaced apart from the hub 143. A plurality of blades 145 may be disposed between the shroud 144 and the hub 143.

Accordingly, when the fan motor 142 is driven, air can be suctioned inside in the axial direction of the fan motor 142 (that is, the longitudinal direction of the rotary shaft) through the intake port 141*a* and can be discharged in the radial direction of the fan motor 42 (that is, the radial direction of the hub 43) and upward from the fan motor 42.

Meanwhile, the air guide 150 can provide a channel 150*p* through which the air discharged from the fan 140 flows. For example, the channel 150*p* may be an annular channel. The air guide 150 may include a guide body 151, a motor cover 152, and a vane 153.

The guide body 151 may form the external shape of the air guide 150. The motor cover 152 may be disposed at the middle portion of the air guide 150. For example, the guide body 151 may be formed in a cylinder shape. Further, the motor cover 152 may be formed in a bowl shape. In this case, the annular channel 150*p* described above may be formed between the guide body 151 and the motor cover 152. The vane 153 can guide upward the air provided to the channel 150*p* from the fan 140. A plurality of vanes 153 may be disposed in the annular channel 150*p* and may be spaced apart from each other in the circumferential direction of the guide body 151. In this case, the plurality of vanes 153 each may extend to the inner circumferential surface of the guide body 151 from the outer surface of the motor cover 152.

Meanwhile, the upper body 120 may provide a channels 120*p* through which air that has passed through the air guide 150 flows. That is, the air that has passed through the air guide 50 can flow up through the channel 120*p* (see arrows in FIG. 13).

Figure 14:
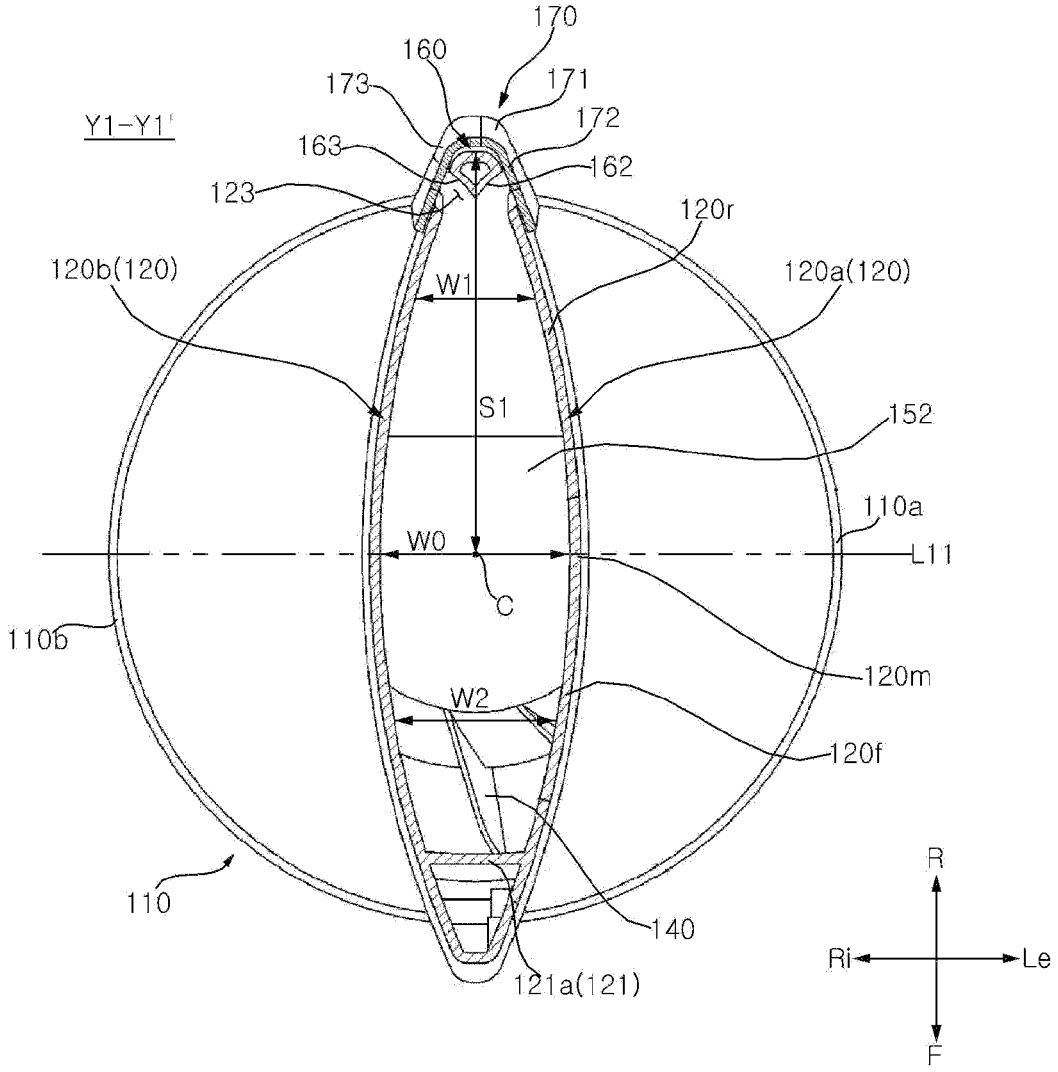
FIG. 14 shows a cross-section taken along line Y1-Y1' of FIG. 10.

Referring to FIGS. 13 and 14, the front-rear length of the upper body 120 may be the same as or larger than the diameter of the lower body 110. The left-right width of the upper body 120 may be smaller than the diameter of the lower body 110. For example, the left-right width of the upper body 120 may be smaller than ⅓ of the diameter of the lower body 110.

The upper body 120 may be divided into a rear part 120*r*, a front part 120*f*, and a middle part 120*m* in the front-rear direction. The rear part 120*r* may extend forward while forming the rear end of the upper body 120. In this case, the left-right width W1 of the rear part 20*r* may increase forward. The front part 120*f* may extend rearward while forming the front end of the upper body 120. In this case, the left-right width W2 of the front part 120*f* may increase rearward. The middle part 120*m* may be positioned between the rear part 120*r* and the front part 120*f*. In this case, the middle part 120*m* may be connected or coupled to the front end of the rear part 120*r* and the rear end of the front part 120*f*. In other words, the left-right width W0 of the middle part 120*m* may be the maximum width of the upper body 120. Meanwhile, the middle part 120*m* may be positioned at the middle of the upper body 120, ahead of the middle, or behind the middle.

For example, the upper body 120 may include a first upper body 120*a* and a second upper body 120*b* that are combined with each other. In this case, the first upper body 120*a* may form the left side of the upper body 120 and the second upper body 120*b* may form the right side of the upper body 120. Further, the shape of the first upper body 120*a* and the shape of the second upper body 120*b* may symmetric in the left-right direction. In this case, the rear part 120*r*, the front part 120*f*, and the middle part 120*m* may be formed at each of the first upper body 120*a* and the second upper body 120*b*.

Further, the inner surface of the upper body 120 may define the boundary of the channel 20*p* described above. Further, an opening 123 may be formed at the rear end of the upper body 120 and may communicate with the channel 20*p*. In detail, the opening 123 may be formed and elongated in the up-down direction between the rear end of the rear part 24*r* of the first upper body 120*a* and the rear end of the rear part 24*r* of the second upper body 120*b*. Accordingly, the air flowing through the channel 20*p* of the upper body 120 can be discharged rearward from the upper body 120 through the opening 123.

A rib 121 may be coupled to the inner surface of the upper body 120. The rib 121 can guide air, which flows up in the channel 120*p*, to the opening 123. The rib 121 may define a portion of the boundary of the channel 120*p*. The rib 121 may include a first part 121*a* and a second part 121*b*. The first part 121*a* may be elongated in the up-down direction and the second part 121*b* may bend from the upper end of the first part 121*a* and then extend rearward. In this case, the joint of the first part 121*a* and the second part 121*b* may be rounded. Meanwhile, the rib 121 may be referred to as a channel guide.

A vane 122 may be coupled to the inner surface of the upper body 120. The vane 122 may be positioned behind the first part 121*a* and under the second part 121*b*. The vane 122 can guide air, which flows up in the channel 120*p*, to the opening 123. The vane 122 may have an upwardly convex shape. The vane 122 may include a plurality of vanes 122*a* and 122*b* spaced apart from each other in the up-down direction. In this case, the lengths of the plurality of vanes 122*a* and 122*b* may be different. For example, the vane positioned relatively upward of the plurality of vanes 122*a* and 122*b* may be larger in length than the vane positioned relatively downward. The rear end of each of the plurality of vanes 122*a* and 122*b* may be spaced forward apart from the opening 123.

The damper 170 may be positioned behind the opening 123. The damper 170 can be moved forward and rearward by moving assemblies 180 and 190 to be described below. The damper 170 may include a body 171, a first guide 172, and a second guide 173.

The body 171 is positioned behind the opening 123 and may form the rear surface of the damper 170. The body 171 may be elongated in the up-down direction. Meanwhile, the body 171 may be referred to as a plate.

The first guide 172 may extend left and forward at an angle from the left end of the plate 171. The first guide 172 can move with the body 171 in the front-rear direction. In this case, a portion of the inner surface of the first guide 172 may come in contact with or may be spaced rearward from a portion of the outer surface of the first upper body 120*a*. That is, a portion of the first guide 172 may overlap a portion of the first upper body 120*a* in the front-rear direction. For example, the inner surface of the first guide 172 may be a curved surface or a flat surface.

The second guide 173 may extend right and forward at an angle from the right end of the plate 171. The second guide 173 can move with the body 171 in the front-rear direction. In this case, a portion of the inner surface of the second guide 173 may come in contact with or may be spaced rearward from a portion of the outer surface of the second upper body 120*b*. That is, a portion of the second guide 173 may overlap a portion of the second upper body 120*b* in the front-rear direction. For example, the inner surface of the second guide 173 may be a curved surface or a flat surface.

The damper 170 may be formed entirely in a wedge shape that is concave rearward. That is, the gap between the first guide 172 and the second guide 173 may increase forward.

A splinter 160 may be disposed between the opening 123 and the body 171 of the damper 170. The splinter 160 may be positioned behind the opening 123 and may be spaced apart from the rear end of the upper body 120. Further, the splinter 160 may be coupled to a supporter 167 installed in the internal space of the upper body 120 and the position of the splinter 160 may be fixed. In this case, the supporter 167 can support the splinter 160 from under the splinter 160. Meanwhile, the supporter 167 can cover the second moving assembly 190 to be described below from behind the second moving assembly 190.

The body 161 of the splinter 160 may face the body 171 of the damper 170 and may form the rear surface of the splinter 160. A first inclined surface 162 of the splinter 160 may be a surface facing the rear end of the rear part 120*r* of the first upper body 120*a* and a second inclined surface 163 may be a surface facing the rear end of the rear part 120*r* of the second upper body 120*b*. The first inclined surface 162 and the second inclined surface 163 may be formed at an angle with respect to the body 171. The inclined surface 162 may extend to be inclined left and rearward and the second inclined surface 163 may extend to be inclined right and rearward. That is, the gap between the first inclined surface 162 and the second inclined surface 163 in the left-right direction may increase rearward. Meanwhile, a tip 160*a* (see FIG. 11) may be formed at the joint of the first inclined surface 162 and the second inclined surface 163.

Accordingly, the splinter 160 can divide the air, which is discharged rearward from the opening 123, to the left and right and provide the air to the first guide 172 and the second guide 173.

Figure 15:
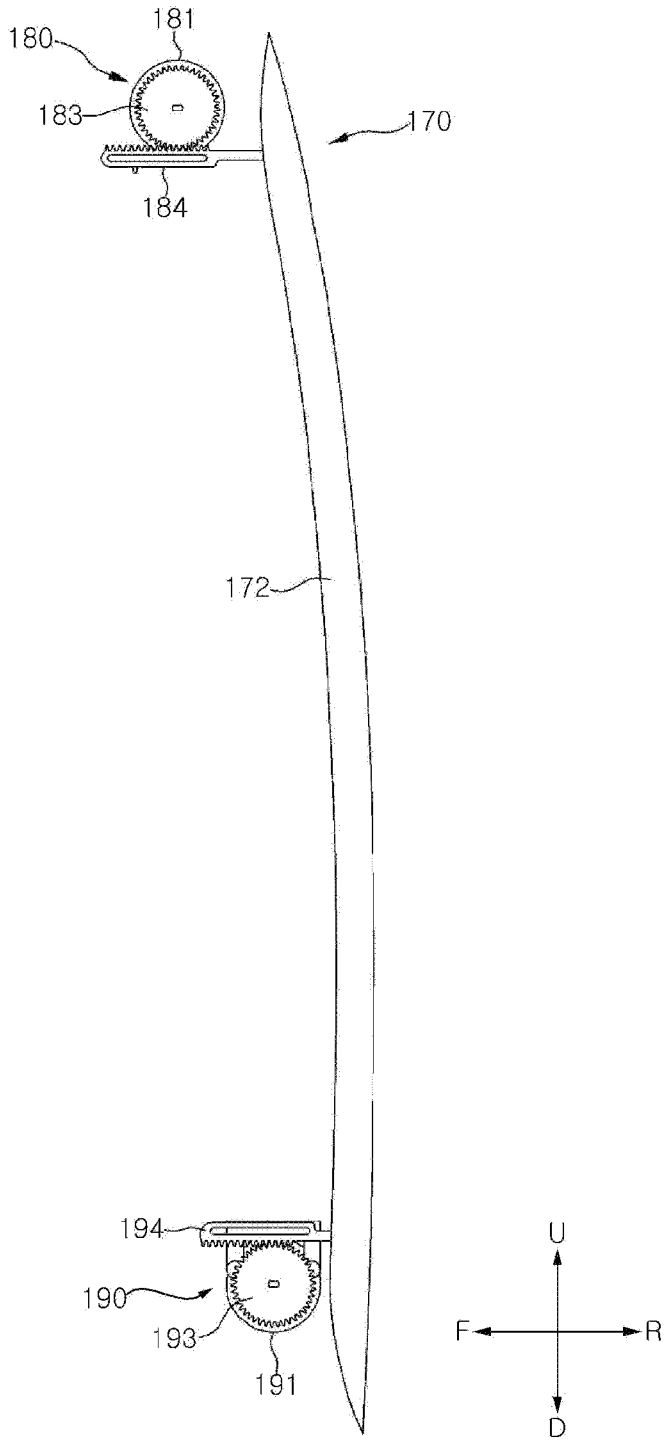
FIGS. 15 to 17 are views illustrating a damper and a moving assembly of the blower according to another embodiment of the present disclosure.
Figure 16:
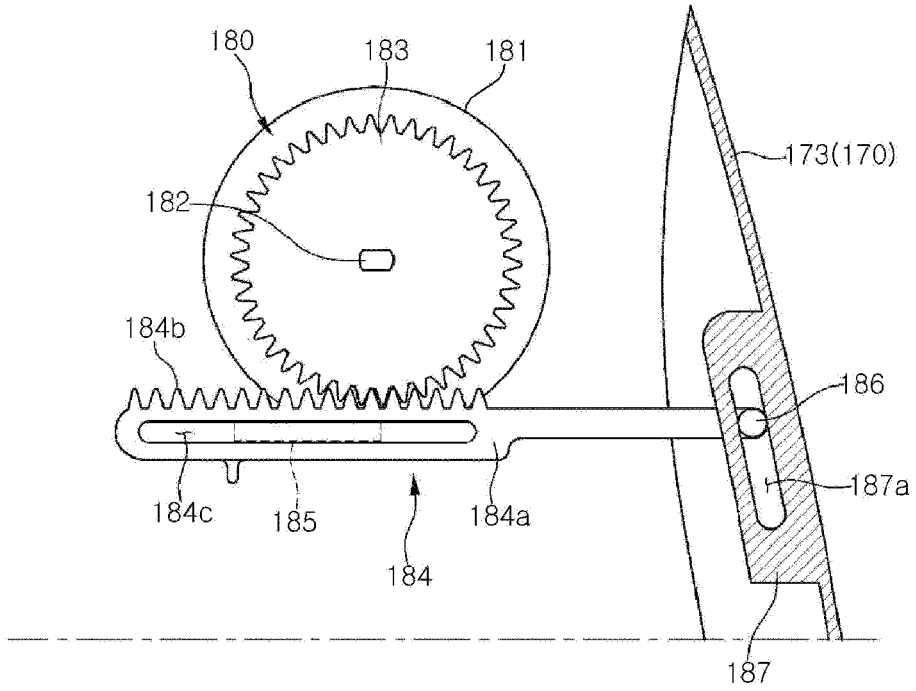
Figure 17:
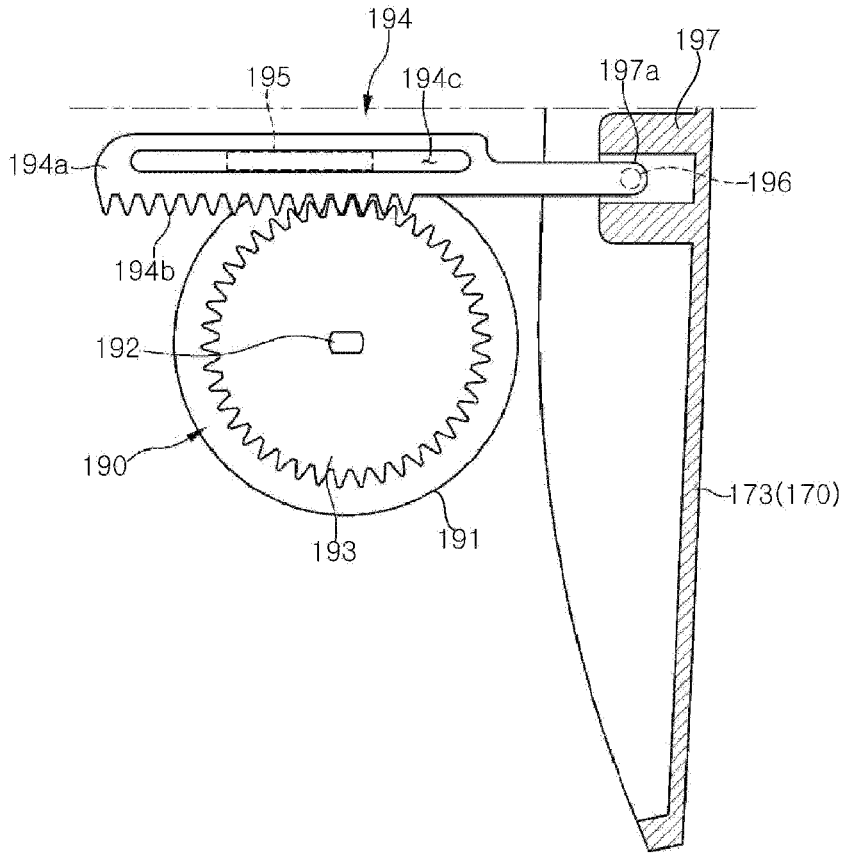

Referring to FIGS. 15 to 17, the moving assemblies 180 and 190 are coupled to the front of the damper 170 and can move the damper 170 in the front-rear direction. The moving assemblies 180 and 190 may be installed in the internal space of the upper body 120 (see FIG. 13). For example, the moving assemblies 180 and 190 may include a first moving assembly 180 and a second moving assembly 190 that are spaced apart from each other in the up-down direction. Meanwhile, the moving assemblies 180 and 190 may be configured as a single moving assembly or may be composed of three or more moving assemblies.

Referring to FIGS. 15 and 16, the first moving assembly 180 may include a first motor 181, a first pinion 183, a first rack 184, a first slider 185, a first pin 186, and a first link 187. The first moving assembly 180 may be adjacent to the upper end of the damper 170.

The first motor 181 can provide a rotational force. The first motor 181 can adjust the rotational direction, rotation angle, and rotation speed of a first rotary shaft 182 of the first motor 181. For example, the first motor 181 may be a step motor. The first motor 181 may be fixed to the inner surface of the upper body 120 through a first bracket (not shown).

The first pinion 183 is coupled to the first rotary shaft 182 and can rotate with the first rotary shaft 182. The first pinion 183 may be engaged with the first rack 184 from above or under the first rack 184.

The first rack 184 may be elongated in the front-rear direction. The first rack 184 is engaged with the first pinion 183 and can move forward or rearward, depending on the rotational direction of the first pinion 183. For example, a first body 184*a* of the first rack 184 may be engaged with the first pinion 183 under the first pinion 183 and may have a top on which gear teeth 184*b* are formed. Meanwhile, a first slot 184*c* may be formed through the first body 184*a* in the left-right direction and may be elongated in the front-rear direction.

The first slider 185 may protrude toward the first slot 184*c* from the inner surface of the upper body 120. The first slider 185 may be movably inserted in the first slot 184*c*. In this case, when the first rack 184 is moved in the front-rear direction, the first slider 185 can slide in the front-rear direction in the first slot 184*c*. That is, the first slider 185 and the first slot 184*c* can guide the first rack 184 moving in the front-rear direction and can restrict up-down and/or left-right movement of the first rack 184.

The first pin 186 may be provided at the rear end of the first body 184*a*. For example, the first pin 186 may protrude left or right from the first body 184*a*. The first rack 184 may be coupled to the damper 170 through the first pin 186 and a first link 187 to be described below.

The first link 187 may be fixed to the inner surface of the first guide 172 or the second guide 173 of the damper 170. A first link hole 187*a* may be formed through the first link 187 in the left-right direction and may be elongated at an angle in the up-down direction. That is, the longitudinal direction of the first link hole 187*a* may be a forwardly and upwardly inclined surface. In this case, the first pin 186 may be movably inserted in the first link hole 187*a*. That is, when the first rack 184 is moved in the front-rear direction, the first pin 186 can press the first link 187 forward or rearward while moving in the first link hole 187*a* in the longitudinal direction of the first link hole 187*a*.

Referring to FIGS. 15 and 17, the second moving assembly 190 may include a second motor 191, a second pinion 193, a second rack 194, a second slider 195, a second pin 196, and a second link 197. The second moving assembly 190 may be adjacent to the lower end of the damper 170.

The second motor 191 can provide a rotational force. The second motor 191 can adjust the rotational direction, rotation angle, and rotation speed of a second rotary shaft 192 of the second motor 191. For example, the second motor 191 may be a step motor. The second motor 191 may be fixed to the inner surface of the upper body 120 through a second bracket (not shown).

The second pinion 193 is coupled to the second rotary shaft 192 and can rotate with the second rotary shaft 192. The second pinion 193 may be engaged with the second rack 194 from above or under the second rack 194.

The second rack 194 may be elongated in the front-rear direction. The second rack 194 is engaged with the second pinion 193 and can move forward or rearward, depending on the rotational direction of the second pinion 193. For example, a second body 194*a* of the second rack 194 may be engaged with the second pinion 193 over the second pinion 193 and may have a bottom on which gear teeth 194*b* are formed. Meanwhile, a second slot 194*c* may be formed through the second body 194*a* in the left-right direction and may be elongated in the front-rear direction.

The second slider 195 may protrude toward the second slot 194*c* from the inner surface of the upper body 120. The second slider 195 may be movably inserted in the second slot 194*c*. In this case, when the second rack 194 is moved in the front-rear direction, the second slider 195 can slide in the front-rear direction in the second slot 194*c*. That is, the second slider 195 and the second slot 194*c* can guide the second rack 194 moving in the front-rear direction and can restrict up-down and/or left-right movement of the second rack 194.

The second pin 196 may be provided at the rear end of the second body 194*a*. The second pin 196 may protrude left or right from the second body 194*a*. The second rack 194 may be coupled to the damper 170 through the second pin 196 and a second link 197 to be described below.

The second link 197 may be fixed to the inner surface of the second guide 172 or the second guide 173 of the damper 170. A second link groove 197*a* may be formed on a side of the second link 197. In this case, the second pin 196 may be rotatably inserted in the second link groove 197*a*. That is, when the second rack 194 is moved in the front-rear direction, the second pin 196 can press the second link 197 forward or rearward while rotating in the first link groove 197*a*.

Accordingly, when the first motor 181 and the second motor 191 are driven, the first rack 184, the second rack 194, and the damper 170 coupled to the racks can move forward or rearward. In this case, forward movement and rearward movement of the damper 170 may be restricted by contact of the first slider 185 and the second slider 195 described above with the inner surfaces of the first body 184*a* and the second body 194*a* defining the boundaries of the first slot 184*c* and the second slot 194*c*.

Meanwhile, unlike the above description, the first motor assembly 180 may be provided adjacent to the lower end of the damper 170 and the second motor assembly 190 may be provided adjacent to the upper end of the damper 170.

Figure 18:
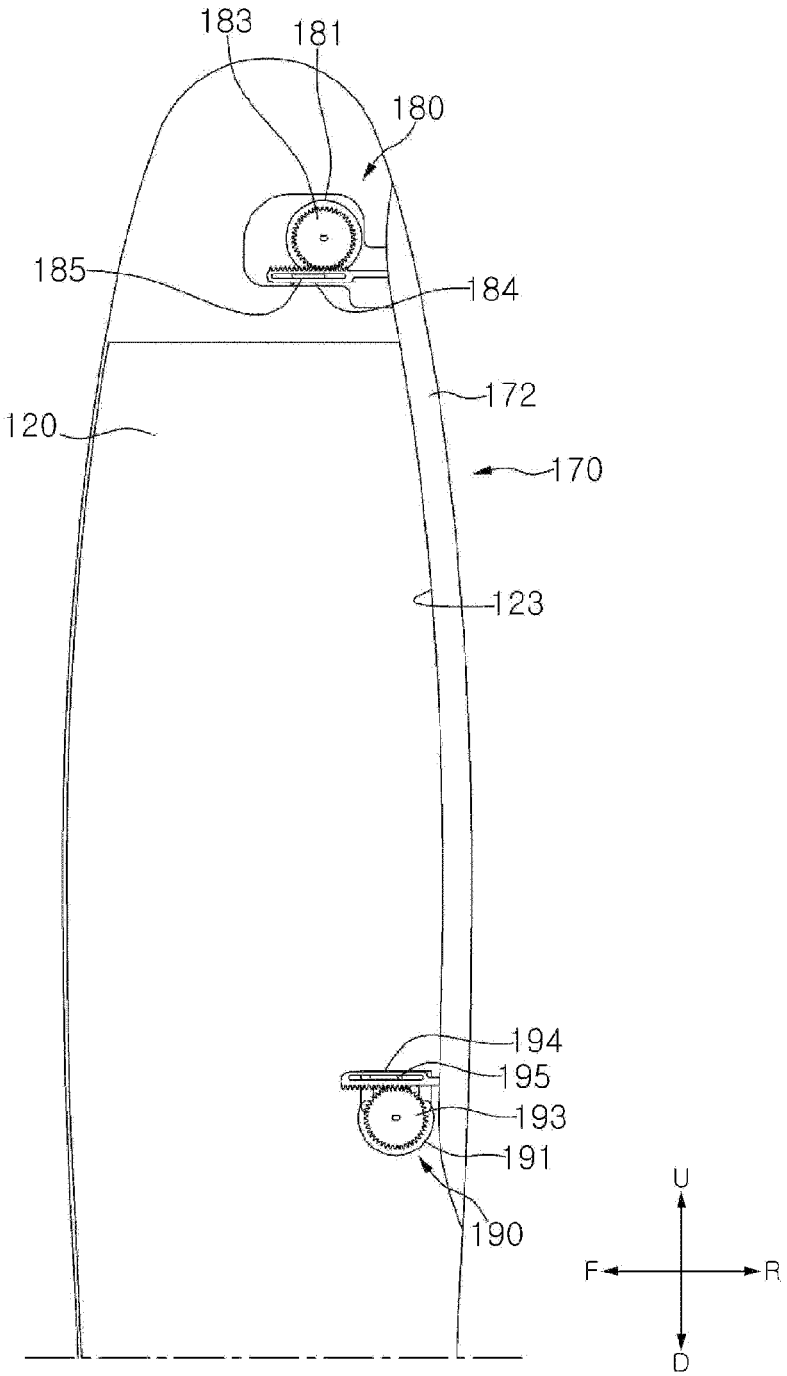
FIG. 18 is a view illustrating a first position of a damper, that is, illustrating closing of a discharge port at the first position of the damper.
Figure 19:
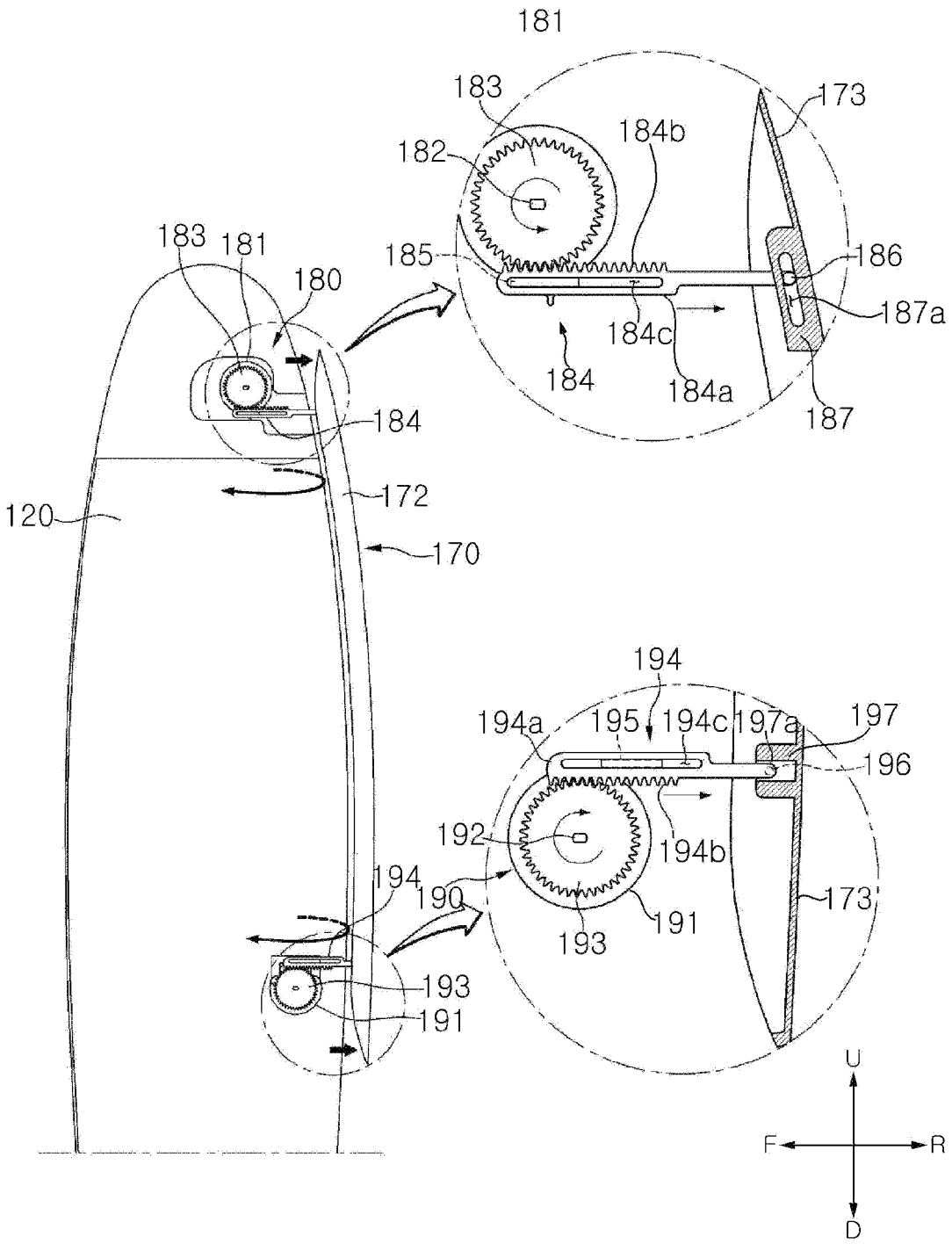
FIGS. 19 and 20 are views illustrating a second position of a damper, that is, illustrating intensive airflow generated by a blower at the second position of the damper.

Referring to FIGS. 14 and 18, when the damper 170 is at a first position, the first guide 172 and the second guide 173 may be in contact with the upper body 120.

In detail, a portion of the inner surface of the first guide 172 may be in contact with a portion of the outer surface of the first upper body 120*a* and a portion of the inner surface of the second guide 173 may be in contact with a portion of the outer surface of the second upper body 120*b*.

To this end, it is possible to control the first rack 184, the second rack 194, and the damper 170 coupled to the racks to be positioned foremost by adjusting operation of the first motor 181 and the second motor 182 described above. In this case, the front surface of the body 171 of the damper 170 may be positioned at a first distance S1 rearward from a virtual line L11 that extends in the left-right direction while passing through the center C of the upper body 120.

Accordingly, first and second discharge ports 172*a* and 173*a* (see FIG. 20) are not formed and the air flowing in the upper body 120 may not be discharged out of the upper body 120. That is, it may be preferable that operation of the fan 140 described above is stopped when the damper 170 is at the first position or in the first state. Meanwhile, this state may be referred to as an off-mode of the blower 100.

Referring to FIGS. 19 to 22, the first guide 172 and the second guide 173 of the damper 170 may be spaced rearward apart from the upper body 20.

In detail, the front end of the first guide 172 may be spaced rearward apart from the rear end of the rear part 120*r* of the first upper body 120*a*. In this case, a first discharge port 172*a* that communicates with the opening 123 may be formed between the front end of the first guide 172 and the rear end of the first upper body 120*a*. The front end of the second guide 173 may be spaced rearward apart from the rear end of the rear part 120*r* of the second upper body 120*b*. In this case, a second discharge port 173*a* that communicates with the opening 123 may be formed between the front end of the second guide 173 and the rear end of the second upper body 120*a*.

To this end, it is possible to control the first rack 184 and the second rack 194 to be moved rearward a firs predetermined distance in comparison to the first position of the damper 170 described above by adjusting operation of the first motor 181 and the second motor 191 described above.

In detail, when the first motor 181 is driven, the first pinion 183 can be rotated counterclockwise and the first rack 184 can be moved rearward. In this case, the first slider 185 may slide forward in the first slot 184*c*. Further, the first pin 186 can press the first link 187 rearward while sliding down along the first link hole 187*a*. Accordingly, the upper portion of the damper 170 can be moved rearward.

Further, when the second motor 191 is driven, the second pinion 193 can be rotated clockwise and the second rack 194 can be moved rearward. In this case, the second slider 195 may slide forward in the second slot 194*c*. Further, the second pin 196 can press the second link 197 rearward while rotating in the second link groove 197*a*. Accordingly, the lower portion of the damper 170 can be moved rearward.

Therefore, when the first motor 181 and the second motor 191 are driven, the damper 170 moves rearward, thereby being able to open the first and second discharge ports 172*a* and 173*a*. In this case, it is possible to control the damper 170 such that the upper portion and the lower portion thereof can be moved rearward in parallel by synchronizing the rotation speed of the first motor 181 and the rotation speed of the second motor 191. Meanwhile, even if the rotation speed of the first motor 181 and the rotation speed of the second motor 191 are different, the damper 170 can be smoothly moved because the first pin 186 described above slides in the first link hole 187*a* and the second pin 196 described above rotates in the second link groove 197*a*. Accordingly, it is possible to minimize noise and prevent damage to the damper 170 while the damper 170 is moved.

For example, when the rotation speed or rotation angle of the first motor 181 is larger than the rotation speed or rotation angle of the second motor 191, the distance that the first rack 184 has moved rearward may be larger than the distance that the second rack 194 has moved rearward. In this case, the second pin 196 can rotate in the second link groove 197*a* and the first pin 186 can move downward along the first link hole 187*a*. Accordingly, while the upper portion and the lower portion of the damper 170 are moved rearward, the upper portion of the damper 170 can rotate clockwise about the second pin 196. As a result, the amount of air discharged through the upper portions of the first and second discharge ports 172*a* and 173 described above may be larger than that through the lower portions.

For example, when the rotation speed or rotation angle of the second motor 191 is larger than the rotation speed or rotation angle of the first motor 181, the distance that the second rack 194 has moved rearward may be larger than the distance that the first rack 184 has moved rearward. In this case, the second pin 196 can rotate in the second link groove 197*a* and the first pin 186 can move upward along the first link hole 187*a*. Accordingly, while the upper portion and the lower portion of the damper 170 are moved rearward, the upper portion of the damper 170 can rotate counterclockwise about the second pin 196. As a result, the amount of air discharged through the lower portions of the first and second discharge ports 172*a* and 173 described above may be larger than that through the upper portions.

Figure 20:
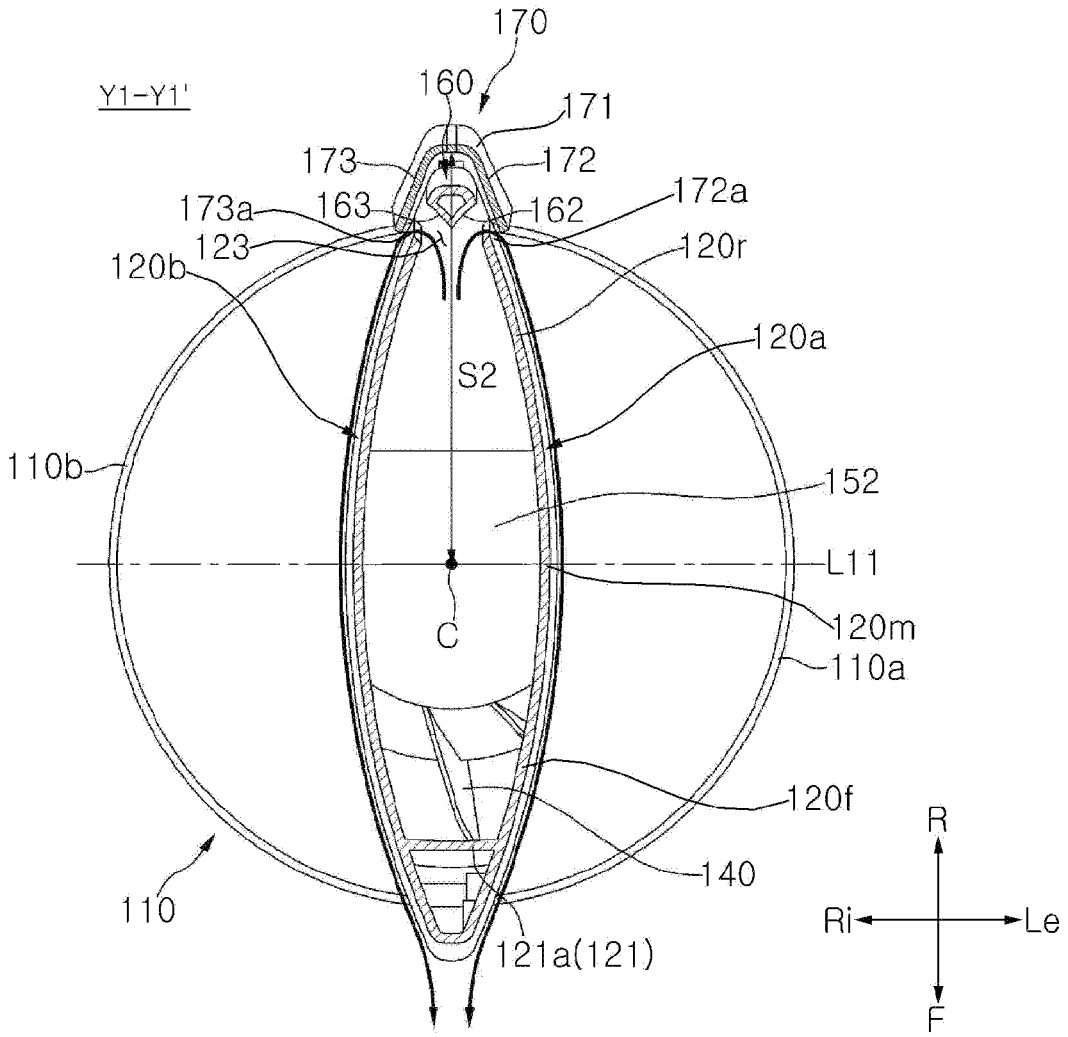

Referring to FIG. 20, for example, when the damper 170 is at a second position or in a second state, the front surface of the body 171 of the damper 170 may be positioned at a second distance S2 rearward from a virtual line V11 that extends in the left-right direction while passing through the center C of the upper body 120. In this case, the second distance S2 may be larger than the first distance S1 (see FIG. 14).

A portion of the first guide 172 can cover a portion of the rear part 120*r* while separating rearward from the rear part 120*r* of the first upper body 120*a*. The first guide 172 can guide the air, which has passed through the opening 123, to the first discharge port 172*a*. Further, the gap between the first guide 172 and the second guide 73 may decrease forward. That is, a tapered area may be formed between the first guide 172 and the rear part 120*r* of the first upper body 120*a*.

A portion of the second guide 173 can cover a portion of the rear part 120*r* while separating rearward from the rear part 120*r* of the second upper body 120*b*. The second guide 173 can guide the air, which has passed through the opening 123, to the second discharge port 173*a*. Further, the gap between the second guide 173 and the rear part 120*r* may decrease forward. That is, a tapered area may be formed between the second guide 173 and the rear part 120*r* of the second upper body 120*b*.

Accordingly, when the fan motor 142 (see FIG. 13) is driven, air can be discharged to the outer surface of the upper body 120 from the first discharge port 172*a* and the second discharge port 173*a*. Further, the air discharged to the outer surface of the upper body 120 can flow forward along the outer surface of the upper body 120 due to Coanda Effect (see arrows in FIG. 20). Further, such flow of air can generate airflow of air moving forward from the rear around the upper body 120. Meanwhile, this state may be referred to as an intensive blow mode of the blower 100.

Figure 21:
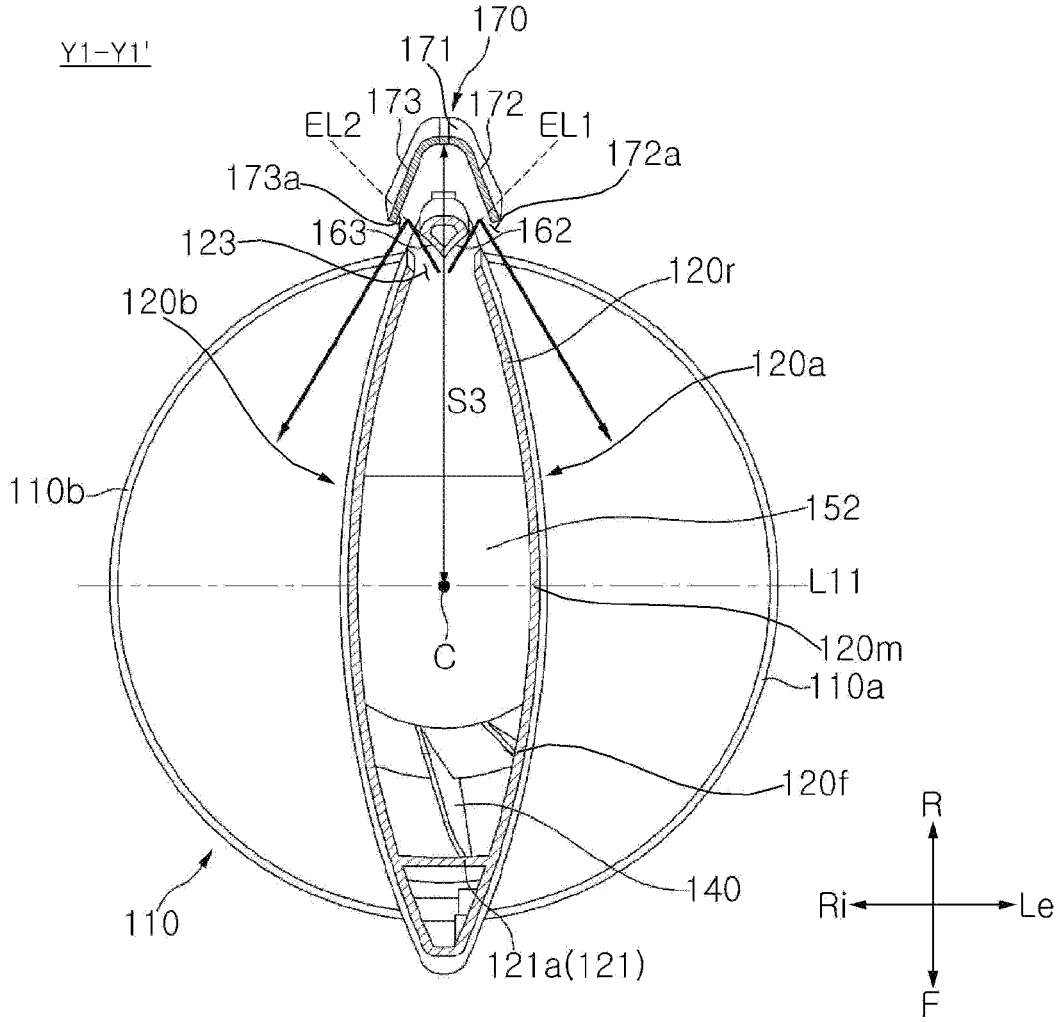
FIG. 21 is a view illustrating a third position of a damper, that is, illustrating spreading airflow generated by a blower at the third position of the damper.

Referring to FIG. 21, for example, when the damper 170 is at a third position or in a third state, the front surface of the body 171 of the damper 170 may be positioned at a third distance S3 rearward from a virtual line V11 that extends in the left-right direction while passing through the center C of the upper body 120. In this case, the third distance S3 may be larger than the second distance S2 (see FIG. 20).

A first extension line EL1 may extend along the first inclined surface 162 of the splinter 160. In this case, the first extension line EL1 may cross or pass the first guide 172. A second extension line EL2 may extend along the second inclined surface 163 of the splinter 160. In this case, the second extension line EL2 may cross or pass the second guide 173.

In this case, since the first guide 172 and the second guide 173 are positioned relatively far from the outer surface of the upper body 120, the amount of air that is guided to the outer surface of the upper body 120 by the first guide 172 and the second guide 173 can be relatively decreased.

Accordingly, when the fan motor 142 (see FIG. 13) is driven, only some of the air that has passed through the opening 123 can be discharged to the outer surface of the upper body 120. That is, in comparison to the second position of the damper 170, the air that is discharged from the blower 100 when the damper 170 is at the third position can flow forward while being distributed or spread in the left-right direction (see arrows in FIG. 21). Meanwhile, this state may be referred to as a spread blow mode of the blower 100.

Figure 22:
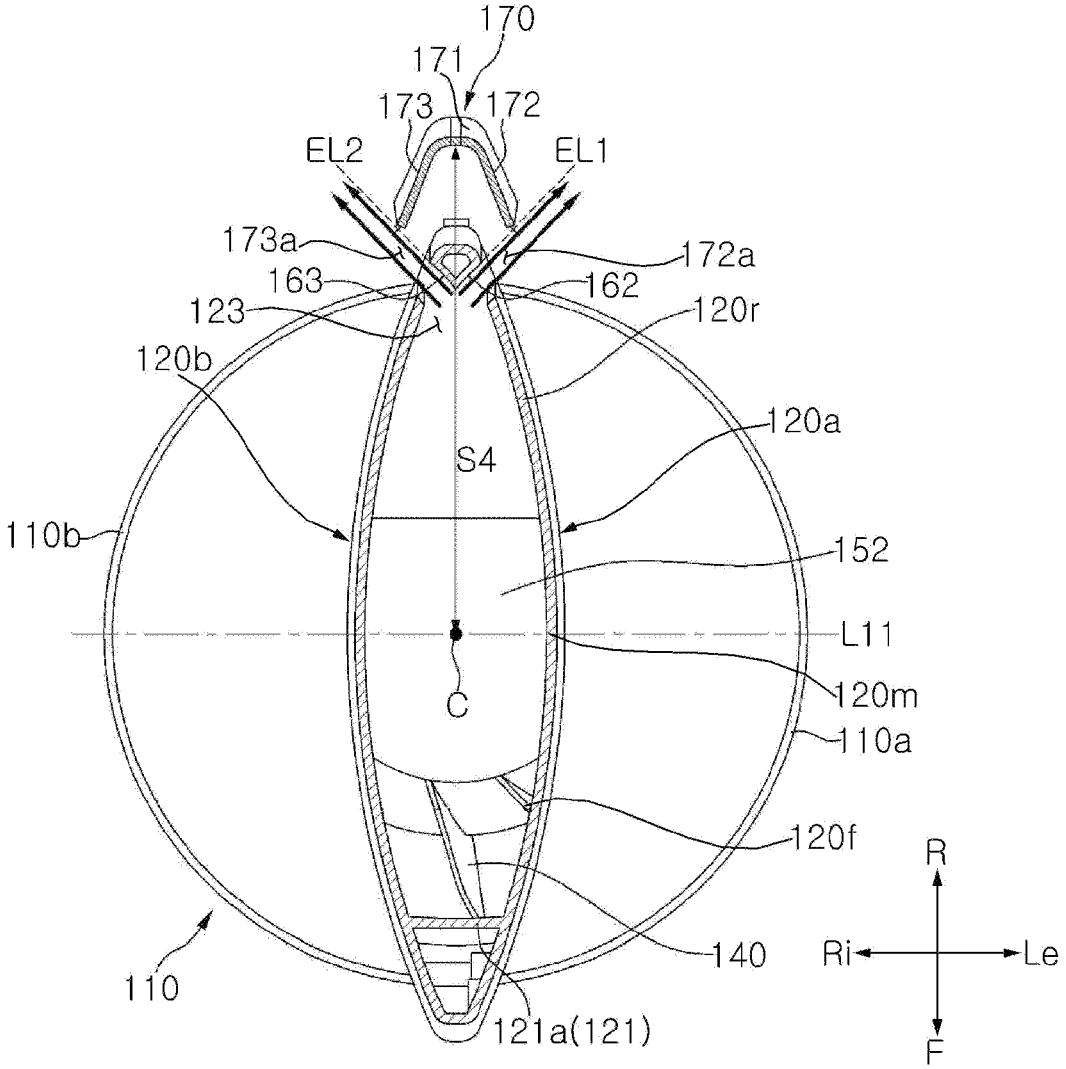
FIG. 22 is a view illustrating a fourth position of a damper, that is, illustrating rear airflow generated by a blower at the fourth position of the damper.

Referring to FIG. 22, for example, when the damper 170 is at a fourth position or in a fourth state, the front surface of the body 171 of the damper 170 may be positioned at a fourth distance S4 rearward from a virtual line V11 that extends in the left-right direction while passing through the center C of the upper body 120. In this case, the fourth distance S4 may be larger than the fourth distance S3 (see FIG. 21).

A first extension line EL1 may extend along the first inclined surface 162 of the splinter 160. In this case, the first extension line EL1 may be in contact with or spaced forward apart from the front end of the first guide 172. A second extension line EL2 may extend along the second inclined surface 163 of the splinter 160. In this case, the second extension line EL2 may be in contact with or spaced forward apart from the front end of the second guide 173.

In this case, since the first guide 172 and the second guide 173 are positioned considerably far from the outer surface of the upper body 120, the amount of air that is guided to the outer surface of the upper body 120 by the first guide 172 and the second guide 173 can be greatly decreased.

Accordingly, when the fan motor 142 (see FIG. 13) is driven, most of the air that has passed through the opening 123 can flow rearward along the first inclined surface 162 and the second inclined surface 163 (see arrows in FIG. 22). Meanwhile, this state may be referred to as a rear blow mode of the blower 100.

Referring to FIG. 22, when the second motor 191 is driven without the first motor 181 driven, the lower portion of the damper 170 can be moved rearward.

In detail, when the second motor 191 is driven, the second pinion 193 can be rotated clockwise, and the second rack 194 and the lower portion of the damper 170 coupled to the second rack 194 can be moved rearward. Further, since the first motor 181 is not driven, the position of the first rack 184 can be maintained. In this case, the first pin 186 is movably inserted in the first link hole 187*a* formed at an angle in the up-down direction, so the damper 170 can move down a predetermine distance while moving rearward. In this case, the first pin 186 can slide up along the first link hole 187*a*.

Figure 23:
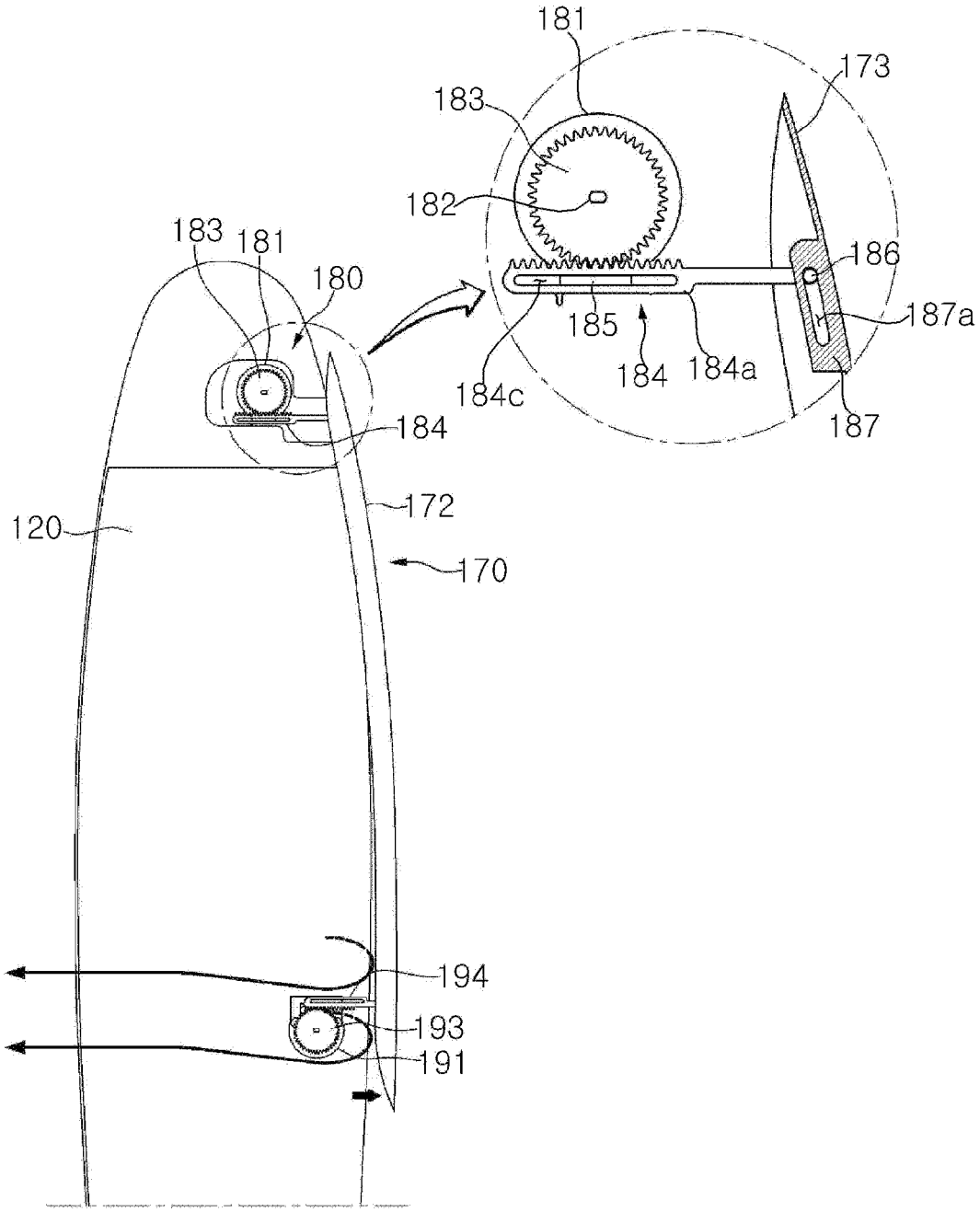
FIG. 23 is a view illustrating rearward movement of the lower portion of a damper.

Accordingly, the damper 170 can close the upper portions of the first and second discharge ports 172*a* and 173*a* (see FIG. 20) and open the lower portions thereof. Therefore, when the fan motor 142 (see FIG. 13) is driven, air can be discharged to the outer surface of the upper body 120 from the lower portions of the first and second discharge ports 172*a* and 173*a* and can flow forward (see arrows in FIG. 23).

Figure 24:
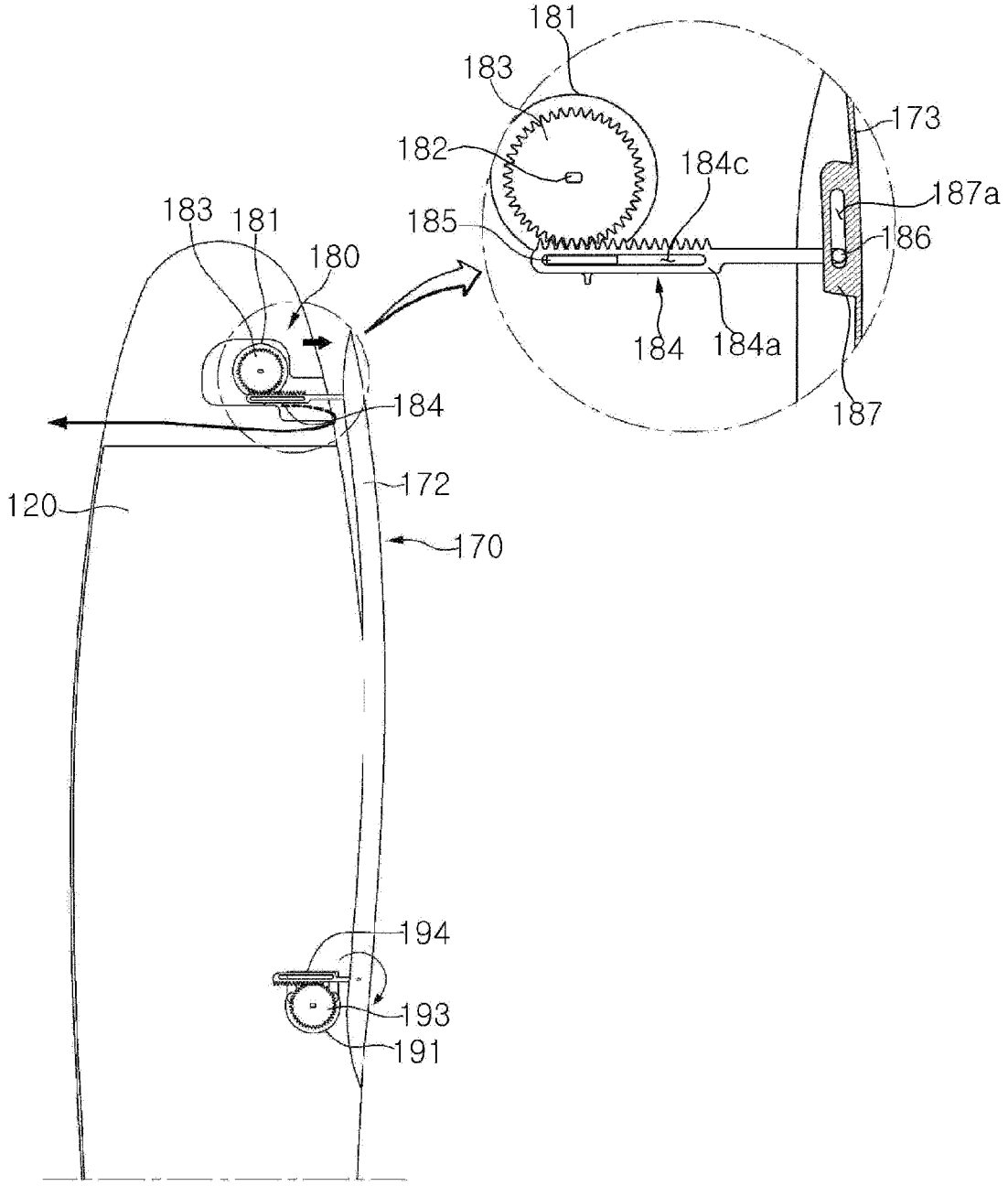
FIG. 24 is a view illustrating rearward movement of the upper portion of a damper.

Referring to FIG. 24, when the first motor 181 is driven without the second motor 191 driven, the upper portion of the damper 170 can be moved rearward.

In detail, when the first motor 181 is driven, the first pinion 183 can be rotated counterclockwise, and the first rack 184 and the upper portion of the damper 170 coupled to the first rack 184 can be moved rearward. Further, since the first motor 191 is not driven, the position of the first rack 194 can be maintained. In this case, since the second pin 196 is rotatably inserted in the second link groove 197*a*, the upper portion of the damper 170 can be moved rearward while the damper 170 rotates clockwise about the second pin 196.

Accordingly, the damper 170 can close the lower portions of the first and second discharge ports 172*a* and 173*a* (see FIG. 20) and open the upper portions thereof. Therefore, when the fan motor 142 (see FIG. 13) is driven, air can be discharged to the outer surface of the upper body 120 from the upper portions of the first and second discharge ports 172*a* and 173*a* and can flow forward (see arrows in FIG. 24).

Some embodiments or other embodiments of the present disclosure described above are not exclusive or discriminated from each other. The configurations or functions of some embodiments or other embodiments of the present disclosure described above may be simultaneously used or combined.

For example, it means that the configuration A described in a specific embodiment and/or the drawings and the configuration B described in another embodiment and/or the drawings may be combined. That is, it means that even if combination of configurations is not directly described, combination is possible unless it is described that combination is impossible.

The detailed description should not be construed as being limited in all respects and should be construed as an example. The scope of the present disclosure should be determined by reasonable analysis of the claims and all changes within an equivalent range of the present disclosure is included in the scope of the present disclosure.

What is claimed is:

1. A blower comprising:

a fan configured to generate flow of air;

a lower body providing an internal space in which the fan is installed, and having a suction hole through which air passes;

an upper body positioned over the lower body, providing an internal space in which air discharged from the fan flows, and including first and second upper bodies having rear ends spaced apart from each other such that an opening is formed therebetween, and the opening communicates with the internal space of the upper body;

a damper positioned behind the upper body and including a plate that extends front-rear direction such that the plate divides the opening into first and second openings, a first guide that extends in left-front direction from a rear end of the plate. and a second guide that extends in right-front direction from the rear end of the plate;

a first discharge port formed between the rear end of the first upper body and a front end of the first guide;

a second discharge port formed between the rear end of the second upper body and a front end of the second guide, wherein the damper opens and closes the first and second discharge ports while moving in a front-rear direction behind the opening.

2. The blower of claim 1, wherein a front-rear length of the upper body is larger than a left-right width of the upper body, the first upper body has an outer surface that is convex to the left, and the second upper body has an outer surface that is convex to the right.

3. The blower of claim 1, further comprising a separation wall disposed in the internal space of the upper body and dividing the internal space of the upper body into a first space positioned at the left of the separation wall and a second space positioned at the right of the separation wall, wherein the plate defines a boundary between the first space and the second space in cooperation with the separation wall, and is coupled to the separation wall to be movable in the front-rear direction.

4. The blower of claim 3, further comprising a moving assembly coupled to the separation wall and the plate between the separation wall and the plate, wherein the moving assembly further includes:

a motor configured to provide rotational force;

a pinion connected to a rotary shaft of the motor; and a rack extending forward from a front end of the plate and engaged with the pinion, and the separation wall further includes a slot formed through the separation wall in the front-rear direction and having the rack inserted to be movable in the front-rear direction therein.

5. The blower of claim 1, wherein the first guide and the second guide close the first discharge port and the second discharge port by coming in contact with the rear ends of the first upper body and the second upper body, respectively, or open the first discharge port and the second discharge port by separating rearward from the rear ends of the first upper body and the second upper body, respectively.

6. The blower of claim 5, wherein a motor can adjust the degrees that the first guide and the second guide are spaced rearward apart from the rear ends of the first upper body and the second upper body, respectively.

7. A blower, comprising:

a fan configured to generate flow of air;

a lower body providing an internal space in which the fan is installed, and having a suction hole through which air passes;

an upper body positioned over the lower body, providing an internal space in which air discharged from the fan flows, and the upper body includes first and second upper bodies having rear ends spaced apart from each other such that forming an opening therebetween which is communicating with the internal space of the upper body;

a damper positioned behind the upper body, and including a body positioned behind the opening and forming a rear surface of the damper, a first guide elongated at an angle left and forward from a left end of the body, and a second guide elongated at an angle right and forward from a right end of the body;

a first discharge port formed between the first guide and the first upper body; and a second discharge port formed between the second guide and the second upper body, wherein the damper opens and closes the first and second discharge ports while moving in a front-rear direction behind the opening.

8. The blower of claim 7, wherein the first guide covers a portion of the first upper body, and the second guide covers a portion of the second upper body.

9. The blower of claim 7, further comprising a splinter disposed between the opening and the body, wherein the splinter further includes:

a first inclined surface facing the rear end of the first upper body and formed at an angle with respect to a front surface of the body; and a second inclined surface facing the rear end of the second upper body and formed at an angle with respect to a front surface of the body, and a gap between the first inclined surface and the second inclined surface in a left-right direction increases rearward.

10. The blower of claim 9, further comprising a moving assembly installed in the internal space of the upper body and coupled to the damper, wherein the moving assembly further includes:

a motor configured to provide rotational force;

a pinion connected to a rotary shaft of the motor; and a rack elongated in the front-rear direction and engaged with the pinion, and the rack is movably or rotatably coupled to the first guide or the second guide.

11. The blower of claim 10, wherein the rack further includes a slot formed through the rack in the left-right direction and elongated in the front-rear direction, and the blower further includes a slider protruding toward the slot from an inner surface of the first upper body or an inner surface of the second upper body, and inserted in the slot to be movable in the front-rear direction.

12. The blower of claim 10, wherein the moving assembly further includes a first moving assembly and a second moving assembly that are spaced apart from each other in the up-down direction, wherein the first moving assembly further includes:

a first pin provided at a rear end of a rack of the first moving assembly; and a first link fixed to an inner surface of the first guide or an inner surface of the second guide and having the first pin coupled thereto to be movable in a direction crossing the front-rear direction, and wherein the second moving assembly further includes:

a second pin provided at a rear end of a rack of the second moving assembly; and a second link fixed to an inner surface of the first guide or an inner surface of the second guide and having the second pin rotatably coupled thereto.

13. The blower of claim 12, wherein the first link further includes a first link hole formed through the first link in the left-right direction, elongated forward and upward, and having the first pin movably inserted therein, and the second link includes:

a second link; and a second link groove in which the second pin is rotatably inserted.

14. The blower of claim 12, wherein the rack of the first moving assembly is engaged with a pinion of the first moving assembly under the pinion of the first moving assembly, and the rack of the second moving assembly is engaged with a pinion of the second moving assembly over the pinion of the second moving assembly.

15. The blower of claim 12, wherein a rotation speed of a motor of the first moving assembly can be synchronized with or controlled to be different from a rotation speed of a motor of the second moving assembly.

16. The blower of claim 12, wherein the first moving assembly and the second moving assembly can be controlled such that any one of them is not driven and the other one is driven.

17. The blower of claim 12, wherein inner surfaces of the first guide and the second guide close the first discharge port and the second discharge port by coming in contact with outer surfaces of the first upper body and the second upper body, respectively, or open the first discharge port and the second discharge port by separating rearward from the outer surfaces of the first upper body and the second upper body, respectively.

18. The blower of claim 17, wherein the first guide crosses or separates rearward from a first extension line extending along the first inclined surface when the first discharge port is opened, and the second guide crosses or separates rearward from a second extension line extending along the second inclined surface when the second discharge port is opened.

* * * * *